US009447578B2

(12) United States Patent
DeBoer

(10) Patent No.: US 9,447,578 B2
(45) Date of Patent: Sep. 20, 2016

(54) MODULAR BLOCK WALL SYSTEM

(71) Applicant: Richard Nelson DeBoer, Grand Rapids, MI (US)

(72) Inventor: Richard Nelson DeBoer, Grand Rapids, MI (US)

( * ) Notice: Subject to any disclaimer, the term of this patent is extended or adjusted under 35 U.S.C. 154(b) by 0 days.

(21) Appl. No.: 14/588,724

(22) Filed: Jan. 2, 2015

(65) Prior Publication Data

US 2016/0194868 A1 Jul. 7, 2016

(51) Int. Cl.

| | |
|---|---|
| ***E04B 1/02*** | (2006.01) |
| ***E04B 2/32*** | (2006.01) |
| ***E04C 1/41*** | (2006.01) |
| ***E04C 1/00*** | (2006.01) |
| *E04B 2/02* | (2006.01) |

(52) U.S. Cl.

CPC . *E04B 2/32* (2013.01); *E04C 1/00* (2013.01); *E04C 1/41* (2013.01); *E04B 2002/0247* (2013.01); *E04B 2002/0293* (2013.01); *E04B 2103/02* (2013.01)

(58) Field of Classification Search

CPC ..... E04B 2/32; E04B 2002/0293; E04B 2002/0247; E04B 2103/02; E04C 1/00; E04C 1/41

USPC ..... 52/561, 562, 596, 597, 605, 604, 586.1, 52/582.1

See application file for complete search history.

(56) References Cited

U.S. PATENT DOCUMENTS

| | | | | |
|---|---|---|---|---|
| 1,345,156 | A | 6/1920 | Flynn | |
| 1,420,478 | A | 6/1922 | Forbush | |
| 2,086,571 | A | 7/1937 | Novambere | |
| 2,261,510 | A | 11/1941 | Atcheson | |
| 3,529,390 | A * | 9/1970 | Stetter | E04B 2/18 52/285.1 |
| 3,982,369 | A | 9/1976 | Keleske | |
| 4,056,907 | A | 11/1977 | Dolder | |
| 4,148,166 | A | 4/1979 | Toone | |
| 4,177,617 | A | 12/1979 | DeLuca et al. | |
| 4,244,155 | A | 1/1981 | Swiger | |
| 4,285,181 | A | 8/1981 | Van Loghem et al. | |
| 4,380,887 | A | 4/1983 | Lee | |
| 4,433,520 | A | 2/1984 | Maschhoff | |
| 4,503,648 | A | 3/1985 | Mahaffey | |
| 4,517,780 | A | 5/1985 | Lacombe et al. | |

(Continued)

OTHER PUBLICATIONS

Izoduo, Lightweight Composite Building Block, http://www.alibaba.com/product-detail/IZODUO-Lightweight-Composite-Building-Block_115167895.html, Apr. 11, 2011.

*Primary Examiner* — Mark Wendell

(74) *Attorney, Agent, or Firm* — Price Heneveld LLP

(57) ABSTRACT

A modular masonry system includes a plurality of masonry modules each having inner and outer structural members. Top and bottom spanning members extend the length of the inner and outer structural members and are retained within respective upper and lower retaining grooves of the inner and outer structural members. The top spanning member includes a second retaining feature that cooperates with a first retaining feature of the bottom spanning member of an adjacent masonry module. An insulation member is disposed within an interior volume defined between the inner and outer structural members and the top and bottom spanning members. The first retaining feature of each bottom spanning member slidably engages the second retaining feature of at least one vertically adjacent top spanning member. The engagement of the first and second retaining features aligns and secures the engaged masonry modules without the use of mortar.

16 Claims, 16 Drawing Sheets

(56) References Cited

U.S. PATENT DOCUMENTS

| | | | | |
|---|---|---|---|---|
| 4,551,959 | A | 11/1985 | Schmid | |
| 4,574,550 | A | 3/1986 | Maschhoff | |
| 4,614,071 | A | 9/1986 | Sams et al. | |
| 4,641,470 | A | 2/1987 | Baumberger | |
| 4,745,720 | A | 5/1988 | Taylor | |
| 4,802,318 | A | 2/1989 | Snitovski | |
| 4,854,097 | A | 8/1989 | Haener | |
| 4,856,248 | A | 8/1989 | Larson et al. | |
| 5,074,088 | A | 12/1991 | Bergeron et al. | |
| 5,245,810 | A | 9/1993 | Foss | |
| 5,321,926 | A | 6/1994 | Kennedy | |
| 5,381,638 | A | 1/1995 | Andersson | |
| 5,596,853 | A | 1/1997 | Blaney et al. | |
| 5,839,249 | A | 11/1998 | Roberts | |
| 5,845,448 | A | 12/1998 | Potvin | |
| 5,983,585 | A | 11/1999 | Spakousky | |
| 6,134,853 | A | 10/2000 | Haener | |
| 6,189,282 | B1 * | 2/2001 | VanderWerf | E04B 2/14 52/582.1 |
| 6,205,726 | B1 | 3/2001 | Hoadley | |
| 6,412,245 | B1 | 7/2002 | Lane et al. | |
| 6,453,625 | B1 | 9/2002 | Corbett | |
| 6,758,020 | B2 | 7/2004 | Cerrato | |
| 6,851,235 | B2 | 2/2005 | Baldwin | |
| 7,007,436 | B1 | 3/2006 | Kelley | |
| 7,337,589 | B2 | 3/2008 | Meyer | |
| 7,584,584 | B2 | 9/2009 | Fennell, Jr. | |
| 7,762,033 | B2 * | 7/2010 | Scott | E04B 2/06 52/274 |
| 7,784,230 | B2 | 8/2010 | Soux | |
| 7,823,351 | B2 | 11/2010 | Tiberi et al. | |
| 7,905,070 | B2 | 3/2011 | August | |
| 8,171,693 | B2 | 5/2012 | Banova | |
| 2004/0194406 | A1 | 10/2004 | Park | |
| 2007/0028817 | A1 * | 2/2007 | Parker | E04B 2/06 110/336 |
| 2007/0245660 | A1 * | 10/2007 | Scott | E04B 2/06 52/438 |
| 2010/0018146 | A1 * | 1/2010 | Aube | E02D 29/0233 52/483.1 |
| 2010/0095629 | A1 | 4/2010 | Taylor | |
| 2011/0072753 | A1 * | 3/2011 | MacDonald | E02D 29/025 52/562 |

* cited by examiner

MODULAR BLOCK WALL SYSTEM

FIELD OF THE INVENTION

The present invention generally relates to block-type building materials, and more specifically, a modular block and a modular block wall system that does not necessarily require the use of mortar.

BACKGROUND OF THE INVENTION

Buildings and other structures are commonly built with masonry units that are stacked upon one another to provide a structural foundation upon which various other aspects of the building can be attached and supported. These masonry walls typically include a modular system of generally concrete or earthen modular units that are stacked in a predefined pattern and typically held together with mortar or another cement-based material.

SUMMARY OF THE INVENTION

According to one aspect of the present invention, a block module for a modular block system includes inner and outer structural members, wherein each of the inner and outer structural members includes upper and lower retaining grooves. A bottom spanning member extends a length of the inner and outer structural members, wherein the bottom spanning member is configured to be retained within the lower retaining grooves of the inner and outer structural members, and wherein the bottom spanning member includes a first retaining feature. A top spanning member extends the length of the inner and outer structural members, wherein the top spanning member is configured to be retained within the upper retaining grooves of the inner and outer structural members, and wherein the top spanning member includes a second retaining feature that is configured to cooperate with the first retaining feature of an adjacent block module. An insulation member is disposed within an interior volume defined between the inner and outer structural members and the top and bottom spanning members, wherein the insulation member is compressed between the inner and outer structural members, and wherein the top and bottom spanning members engage the upper and lower retaining grooves to exert a laterally inward compressive force against the inner and outer structural members to compress the insulation member between the inner and outer structural members and secure the inner and outer structural members, the top and bottom spanning members and the insulation member in a unitary member.

According to another aspect of the present invention, a modular block system includes a plurality of block modules. Each of these block modules includes inner and outer structural members including upper and lower retaining grooves. A bottom spanning member is included that extends the length of the inner and outer structural members, and is configured to be retained within the lower retaining grooves of the inner and outer structural members. The bottom spanning member also includes a first retaining feature. A top spanning member extends the length of the inner and outer structural members and is configured to be retained within the upper retaining grooves of the inner and outer structural members. The top spanning member includes a second retaining feature that cooperates with the first retaining feature of an adjacent masonry module. An insulation member is disposed within an interior volume defined between the inner and outer structural members and the top and bottom spanning members. The first retaining feature of each bottom spanning member of the plurality of masonry modules is adapted to slidably engage the second retaining feature of at least one vertically adjacent top spanning member of the plurality of block modules such that the engagement of the first and second retaining features serves to laterally and vertically align and secure the plurality of block modules that are so slidably engaged. When assembled, the plurality of block modules are aligned and secured to form a structural unit that is free of the use of mortar.

According to another aspect of the present invention, a modular block system includes a plurality of block modules each including a top spanning panel including first and second securing members extending from opposite edges of the bottom spanning panel and a bottom spanning panel including third and fourth securing members extending toward the first and second securing members and a first retaining feature defined within the opposite edges of the top spanning panel. An inner structural member extends perpendicularly between one of the first and second securing members and one of the third and fourth securing members. An outer structural member extends perpendicularly between the other of the first and second securing members to the other of the third and fourth securing members and the top and bottom spanning panels extend substantially the length of the inner and outer structural members to space the inner and outer structural members at a predetermined distance. The inner and outer structural members and the top and bottom spanning members define an interior volume therein. An insulation member is disposed within the interior volume, wherein the inner and outer structural members extend between one of the top and bottom spanning members. The first retaining feature of the bottom spanning panel of one of a first block module of the plurality of block modules is adapted to slidably engage the opposite edges of the top spanning panel of at least one vertically adjacent block modules of the plurality of block modules. The slidable engagement between the first block module and the at least one vertically adjacent block module secures and vertically and laterally aligns the first and the at least one vertically adjacent block modules free of the use of mortar, wherein the first block module is unable to slidably engage two block modules of the at least one vertically adjacent block module when the two block modules are free of at least one of vertical and lateral alignment.

According to another aspect of the present invention, a method for assembling a mortar free modular block system includes providing a plurality of block modules, each including inner and outer structural members including upper and lower retaining grooves. A bottom spanning member extends the length of the inner and outer structural members and is configured to be retained within the lower retaining grooves of the inner and outer structural members. The bottom spanning member includes a first retaining feature. A top spanning member extends the length of the inner and outer structural members and is configured to be retained within the upper retaining grooves of the inner and outer structural members. The top spanning member includes a second retaining feature that cooperates with the first retaining feature of an adjacent block module. An insulation member is disposed within an interior volume defined between the inner and outer structural members and the top and bottom spanning members. At least two adjacent block modules are placed to define a lower course and are vertically and laterally aligned within the lower course. A vertically adjacent block module is slid onto the at least two adjacent block modules within the lower course such that the vertically adjacent block module defines an upper course. The first retaining feature of the vertically adjacent block module slidably engages the second retaining feature of two of the at least two block modules, and a slidable connection between the at least two block modules of the lower course and the vertically adjacent block module of the upper course creates a secure and self-leveling interference connection that is substantially free of mortar.

These and other aspects, objects, and features of the present invention will be understood and appreciated by those skilled in the art upon studying the following specification, claims, and appended drawings.

DETAILED DESCRIPTION OF THE PREFERRED EMBODIMENTS

Figure 1:
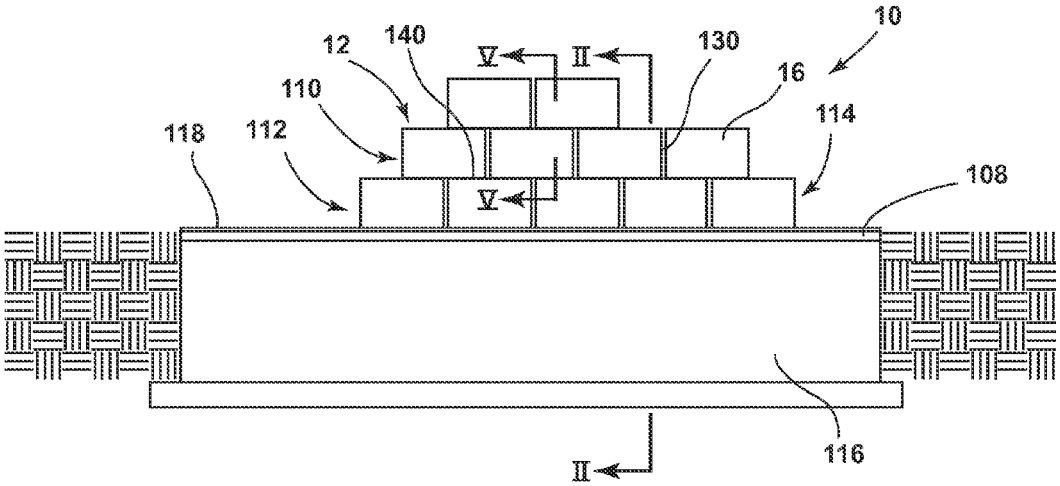
FIG. 1 is a side elevational view of a partially constructed block module wall using an embodiment of the block system.

For purposes of description herein, the terms "upper," "lower," "right," "left," "rear," "front," "vertical," "horizontal," and derivatives thereof shall relate to the invention as oriented in FIG. 1. However, it is to be understood that the invention may assume various alternative orientations, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

As shown in FIGS. 1-12, reference numeral 10 generally refers to a mortarless modular block system for use in assembling structural and non-structural walls used to construct standalone barriers, building enclosures and interior walls, and other types of structures, according to one embodiment. The mortarless modular block system 10 includes a plurality of block modules 12. Each of the plurality of block modules 12 includes inner and outer structural members 14, 16, each having upper and lower retaining grooves 18, 20. A bottom spanning member 22 of the block module 12 extends the length of the inner and outer structural members 14, 16, such that the bottom spanning member 22 is configured to be retained within the lower retaining grooves 20 of the inner and outer structural members 14, 16. The bottom spanning member 22 also includes a first retaining feature 24. Each of the block modules 12 also includes a top spanning member 26 that extends the length of the inner and outer structural members 14, 16 and is configured to be retained within the upper retaining grooves 18 of the inner and outer structural members 14, 16. The top spanning member 26 includes a second retaining feature 28 that is adapted to cooperate with a first retaining feature 24 of an adjacent block module 12. The block module 12 also includes an insulation member 30 that is disposed within an interior volume defined between the inner and outer structural members 14, 16 and the top and bottom spanning members 26, 22. The first retaining feature 24 of each of the bottom spanning members 22 of the plurality of block modules 12 is adapted to slidably engage the second retaining feature 28 of at least one vertically adjacent top spanning member 26 of the plurality of block modules 12 such that the engagement of the first and second retaining features 24, 28 serves to laterally and vertically align and secure the plurality of block modules 12 that are so slidably engaged. When aligned in this manner, the plurality of block modules 12 are substantially secured or structurally secure so as to be free of the use of mortar, or substantially free of the use of mortar.

Referring again to FIGS. 1-11, each of the upper and lower retaining grooves 18, 20 of each block module 12 includes an expanded inner portion 40 defined within each of the inner and outer structural members 14, 16. The expanded inner portion 40 extends the length of each respective inner and outer structural member 14, 16. In this manner, each expanded inner portion 40 is accessible through a securing aperture 42 disposed at an end of the expanded inner portion 40. Accordingly, each securing aperture 42 is defined within an end wall 44 of respective inner and outer structural members 14, 16. Additionally, the top spanning member 26 of each block module 12 includes a first pair of securing members 46 that are configured to be secured within the expanded inner portions 40 of the upper retaining grooves 18 of the inner and outer structural members 14, 16, respectively. Similarly, the bottom spanning member 22 of each block module 12 includes a second pair of securing members 48 that are configured to be secured within the expanded inner portions 40 of the lower retaining grooves 20 of the inner and outer structural members 14, 16. Accordingly, the first and second pairs of securing members 46, 48, when engaged with the upper and lower retaining grooves 18, 20 of the inner and outer structural members 14, 16, are configured to position the inner and outer structural members 14, 16 at a predetermined distance from one another.

According to various embodiments, the block module 12 can include an inner structural member 14 that is substantially thicker than the outer structural member 16 or vice versa. In such an embodiment, the inner structural member 14 of the block module 12 is the primary structural member of the block module 12. The inner structural member 14 can be wide enough to serve as the load-bearing member of each block module 12 to carry the various loads placed upon the mortarless modular block system 10 as a whole. The outer structural member 16, being thinner, serves primarily as a decorative or aesthetic element of the block module 12. The outer structural member 16 can also serve as a weather barrier for each block module 12 and the modular block system 10. The outer structural member 16 may carry some of the load placed upon the mortarless modular block system 10. According to various embodiments, the inner structural member 14 is made of some structural material, including, but not limited to, cement, masonry, wood, metal, plastic, composite, polymer, ceramic, combinations thereof, and other structural materials. The outer structural member 16 can be made of various structural or non-structural materials that include, but are not limited to, wood, ceramic, masonry, concrete, plastic, glass, metal, polymers, stucco, combinations thereof, and others.

In the various embodiments, the expanded inner portion 40 of each of the inner and outer structural members 14, 16 is typically shaped to receive the first and second pairs of securing members 46, 48 that extend from the top and bottom spanning members 26, 22, respectively. As such, each of the expanded inner portions 40 and the first and second pairs of securing members 46, 48 generally have a similar cross-sectional shape. This cross-sectional shape can be any one of multiple shapes which can include, but are not limited to, circular, rectangular, diamond-shaped, arcuate, polygonal, irregular, combinations thereof, or other similar shape that will allow first and second pairs of securing members 46, 48 to be substantially secured within the expanded inner portions 40 of the inner and outer structural members 14, 16. In various alternate embodiments, it is contemplated that the first and second pairs of securing members 46, 48 can have a different cross-sectional shape than the expanded inner portions 40 of the inner and outer structural members 14, 16. These shapes can be dissimilar, so long as the geometries result in the first and second pairs of securing members 46, 48 being secured within the expanded inner portions 40 of the respective inner and outer structural members 14, 16 to properly space the inner and outer structural members 14, 16 the predetermined distance from one another.

Referring again to FIGS. 1-11, each of the first pair of securing members 46 can include first and second securing members 60, 62 and the second pair of securing members 48 can include third and fourth securing members 64, 66. Each of the first, second, third and fourth securing members 60, 62, 64, 66 can include a hollow interior portion 68 that is adapted to receive a corresponding expansion member 70. The insertion of the corresponding expansion member 70 into each hollow interior portion 68 is configured to expand each of the first, second, third and fourth securing members 60, 62, 64, 66 within the corresponding expanded inner portion 40 of the upper and lower retaining grooves 18, 20. In this manner, after the first, second, third and fourth securing members 60, 62, 64, 66 have been inserted within corresponding expanded inner portions 40 of the inner and outer structural members 14, 16, the expansion member 70 can be inserted into the hollow interior portion 68 to at least partially expand each of the first, second, third and fourth securing members 60, 62, 64, 66 outward to further engage the expanded inner portion 40 of the inner and outer structural members 14, 16. This expansion of the first and second pairs of securing members 46, 48 serves to substantially fix each of the first and second pairs of securing members 46, 48 to within the corresponding expanded inner portions 40 of the inner and outer structural members 14, 16.

In the various embodiments, the expansion member 70 can include a substantially cylindrical member that can be inserted within the hollow interior portions 68 of the first, second, third and fourth securing members 60, 62, 64, 66. In the various embodiments, it is contemplated that the expansion member 70 includes a substantially similar geometry to that of the hollow interior portion 68. In various alternate embodiments, it is contemplated that the expansion member 70 can include a geometry different than that of the hollow interior portions 68, wherein the expansion member 70 is configured to have a geometry that efficiently slides within the hollow interior portion 68 of each of the first, second, third and fourth securing members 60, 62, 64, 66 and also efficiently expands the hollow interior portion 68 to provide a substantially secure fit between the first, second, third and fourth securing members 60, 62, 64, 66 and the expanded inner portions 40 of the inner and outer structural members 14, 16. In various alternate embodiments, it is contemplated that the first, second, third and fourth securing members 60, 62, 64, 66 can be solid members with no hollow interior portions 68. In such an embodiment, the expansion member 70 may not be necessary.

As illustrated in the embodiments of FIGS. 1-11, each of the first, second, third and fourth securing members 60, 62, 64, 66 can also include a slot 80 that extends the length of each of the first, second, third and fourth securing members 60, 62, 64, 66. This slot 80 is adapted to foster the expansion of the hollow interior portion 68 of each of the first and second pairs of securing members 46, 48 when the expansion member 70 is inserted into each hollow interior portion 68. In the various embodiments, the slot 80 can include a linear aperture extending the length of the first and second pairs of securing members 46, 48. In various alternate embodiments, the slot 80 can include certain geometries, such as angles, ridges, corners, and other similar geometries that can be adapted to provide an additional engaging surface of each of the first, second, third and fourth securing members 60, 62, 64, 66 within the corresponding expanded inner portions 40 of the inner and outer structural members 14, 16.

In the various embodiments, it is contemplated that the inner and outer structural members 14, 16 can be made of a cement-based material, such as concrete, or other similar masonry material. In forming each of the inner and outer structural members 14, 16, the inner and outer structural members 14, 16 can be cured within forms using a curing process that implements portland cement and water. Alternatively, the inner and outer structural members 14, 16 can be oven baked or oven cured to arrive at the final dimensional configuration described and shown in the various embodiments. In the various embodiments, the upper and lower retaining grooves 18, 20 and the expanded inner portions 40 defined therein can be formed during the creation of each of the inner and outer structural members 14, 16. In various alternate embodiments, the upper and lower retaining grooves 18, 20 and the expanded inner portions 40 can be formed through removing material from the pre-manufactured inner and outer structural members 14, 16. In such an embodiment, the upper and lower retaining grooves 18, 20 can be defined through grinding, cutting and other similar material-removing operations. It is also contemplated that the inner and outer structural members 14, 16 can be made of various other materials including, but not limited to, stone, reinforced concrete, wood, metal, plastic, ceramic, combinations thereof, and other similar materials.

It is contemplated that, in the various embodiments, the top and bottom spanning members 26, 22 can be made of various materials that can include, but are not limited to, plastic, metal, polymers, composite materials, combinations thereof, and other similar rigid and substantially sturdy materials that can be used to link the various block modules 12 together. It is further contemplated that the insulation member 30 of each of the block modules 12 can be a solid piece or a block of insulation, a spray-foam-type insulation, insulative batting, rolled insulation, or other similar insulating material that can be disposed within and substantially retained within the interior volume defined between the inner and outer structural members 14, 16 and the top and bottom spanning members 26, 22. In various alternate embodiments, each masonry member can include end panels that substantially contain the insulation member 30 within the interior volume that is further defined by the end panels of each block module 12. It is contemplated that end panels can include latching or connecting mechanisms that are configured to engage and at least partially retain a mating portion of an adjacent panel of a vertically or laterally adjacent block module 12. In this manner, the end panels can assist in locating and/or positioning the block modules 12 to form the structural wall of the mortarless modular block system 10.

Referring again to FIGS. 4-11, the top spanning member 26 of each of the block modules 12 can include a second retaining feature 28 that includes at least one engagement rail that is configured to engage one of the opposite sides of the bottom spanning member 22 of at least one vertically adjacent block module 12. In this manner, the second retaining feature 28 is configured to slidably engage the vertically adjacent bottom spanning member 22. In the various embodiments, the second retaining feature 28 can include opposing first and second engagement rails 90, 92 that extend toward one another. The opposing first and second engagement rails 90, 92, which extend from the planar surface 94 of the top spanning member 26, are adapted to receive the first retaining feature 24 of the bottom spanning member 22 of the at least one vertically adjacent block module 12. It is contemplated that the first retaining feature 24 and the bottom spanning member 22 can define a single continuous planar unit where the first retaining feature 24 is co-planar with the bottom spanning member 22 and extends outward and beyond the third and fourth securing members 64, 66 located at the opposite edges of the bottom spanning member 22. Accordingly, the first retaining feature 24 is adapted to slide between the first and second engagement rails 90, 92 defined within the second retaining feature 28 of the top spanning member 26.

In the various embodiments, the first and second retaining features 24, 28 can be switched such that the first and second engagement rails 90, 92 are disposed within the bottom spanning member 22 and the top spanning member 26 includes the substantially planar surface 94 that incorporates the first retaining feature 24. In still other alternate embodiments, each of the first and second retaining features 24, 28 can include one engagement rail that engages a substantially planar portion defined within the other of the top and bottom spanning members 26, 22. It is also contemplated that each of the first and second retaining features 24, 28 can include first and second engagement rails 90, 92 that slidably and matingly engage one another to securely connect the vertically adjacent block modules 12. In the various embodiments, each of the top and bottom spanning members 26, 22 can include respective top and bottom spanning panels that extends between the components of the respective second and first retaining features 28, 24.

It is contemplated that, in various embodiments, the first and second retaining features 24, 28 may extend along only a portion of the respective bottom and top spanning members 22, 26. In such an embodiment, the first and second retaining features 24, 28 can be shorter in length than the respective bottom and top spanning members 22, 26. In such an embodiment, the first and second retaining features 24, 28 can be intermittently spaced. In this manner, the block modules 12 can be placed upon a particular course at an internal portion of the lower course. This configuration allows the block modules 12 to be placed on and structurally secured to the lower course without having to engage the block module at the end of the lower course and sliding the block module 12 along potentially long stretches of the already secured lower course. Rather, this configuration allows the block module 12 to be engaged along the interior block modules 12 of the lower course such that the intermittently spaced first and second retaining features 24, 28 provide internal insertion points at which the block modules can be engaged with the lower course.

According to various embodiments, the first and second retaining features 24, 28 can define a snapping-type connection that connects two vertically adjacent block modules 12. In such an embodiment, the first and second retaining features 24, 28 can snap together such that the snapping engagement positions the adjacent block modules 12 in the appropriate predetermined configuration. Additionally, the snapping engagement can incorporate the self-leveling feature such that the snapping engagement of the first and second retaining features 24, 28 can only occur when the adjacent block modules 12 are vertically and laterally aligned with one another. It is contemplated that each of the first and second retaining features 24, 28 can include mating profiles that need to be properly aligned in order to achieve the mating engagement between the first and second retaining features 24, 28. The snapping or mating engagement of the first and second retaining features 24, 28 can also result in an interference fit that at least partially retains the connection between the first and second retaining features 24, 28.

According to various embodiments, it is contemplated that the first and second retaining features 24, 28 can be installed directly into or integrated with the inner and outer structural members 14, 16. In such an embodiment, the bottom and top spanning members 22, 26 are not used. Accordingly, the inner and outer structural members 14, 16 are attached to the insulation member 30 through an adhesive or some mechanical attachment, rather than by the bottom and top spanning members 22, 26. In this embodiment, the first and second retaining features 24, 28 can be set within the inner and outer structural members 14, 16 during their formation, such as during curing, baking, cutting, or other formation process of the inner and outer structural members 14, 16. Alternatively, the first and second retaining features 24, 28 can be installed within portions of the inner and outer structural members 14, 16 after they are formed. Such installation can be accomplished through adhesive, structural adhesive, some mechanical attachment or other similar connection method. In this embodiment that does not utilize the bottom and/or top spanning members 22, 26, the first and second retaining features are configured to engage one another in substantially the same manner as the various embodiments described above.

In the various embodiments, the first and second engagement rails 90, 92 of the first retaining feature 24 and/or the second retaining feature 28 can include various geometries that can include, but are not limited to, rectangular geometries, arcuate geometries, irregular geometries, combinations thereof, and other similar geometries that allow for a laterally slidable engagement between vertically adjacent block modules 12. It is further contemplated that the first retaining feature 24 can include opposing first and second engagement rails 90, 92 that extend toward one another to define opposing panel reception channels 96. In such an embodiment, the opposing panel reception channels 96 are adapted to receive the outer edges 98 of the bottom spanning member 22, that define the second retaining feature 28 of the at least one vertically adjacent block module 12.

In the various embodiments, where the first, second, third and fourth securing members 60, 62, 64, 66 include the hollow interior portion 68 and are not solid, the expansion member 70 can include a substantially cylindrical member that can be inserted within the hollow interior portions 68 of the first, second, third and fourth securing members 60, 62, 64, 66. In the various embodiments, it is contemplated that the expansion member 70 includes a substantially similar geometry to that of the hollow interior portion 68. In various alternate embodiments, it is contemplated that the expansion member 70 can include a geometry different than that of the hollow interior portions 68, wherein the expansion member 70 is configured to have a geometry that efficiently slides within the hollow interior portion 68 of each of the first, second, third and fourth securing members 60, 62, 64, 66 and also efficiently expands the hollow interior portion 68 to provide a substantially secure fit between the first, second, third and fourth securing members 60, 62, 64, 66 and the expanded inner portions 40 of the inner and outer structural members 14, 16.

According to the various embodiments, as illustrated in FIGS. 1-12, each block module 12 is designed to be manufactured and assembled off-site. In forming each block module 12, the insulation member 30 is formed into the appropriate shape and dimension for fitting between the inner and outer structural members 14, 16. It is contemplated that no adhesive is used between the insulation member 30 and the inner and outer structural members 14, 16, although, in various embodiments, adhesive may be used. The insulation member 30 and the inner and outer structural members 14, 16 are compressed together with the insulation member 30 being compressed between the inner and outer structural members 14, 16. Once compressed, the top and bottom spanning members 26, 22 are slidably engaged with the inner and outer structural members 14, 16. In this manner, the first, second, third and fourth securing members 60, 62, 64, 66 are slidably inserted into the respective upper and lower retaining grooves 18, 20 to securely position the inner and outer structural members 14, 16 in a compressive engagement with the insulation member 30. Accordingly, the engagement of the first, second, third and fourth securing members 60, 62, 64, 66 with the respective upper and lower retaining grooves 18, 20 maintains the inward compressive force exerted by the inner and outer structural members 14, 16 upon the insulation member 30. The inward compressive force secures the components of each block module 12 in place to form a unitary piece that is substantially free of movement between the components. In various embodiments, the end panels of each block module 12 can serve to further secure the components of the block module 12 permanently in place.

Figure 2:
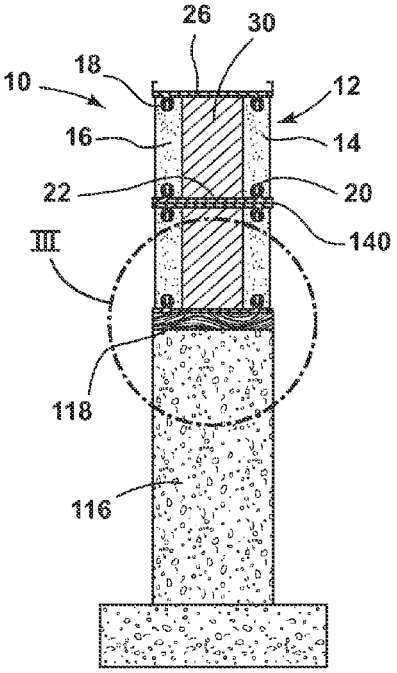
FIG. 2 is a cross-sectional view of the block module wall of FIG. 1 taken along line II-II.
Figure 3:
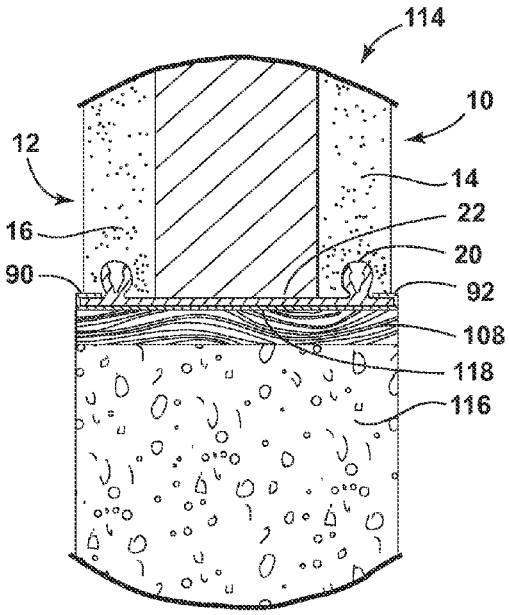
FIG. 3 is an enlarged cross-sectional view of the block module wall of FIG. 2 taken at area III.
Figure 4:
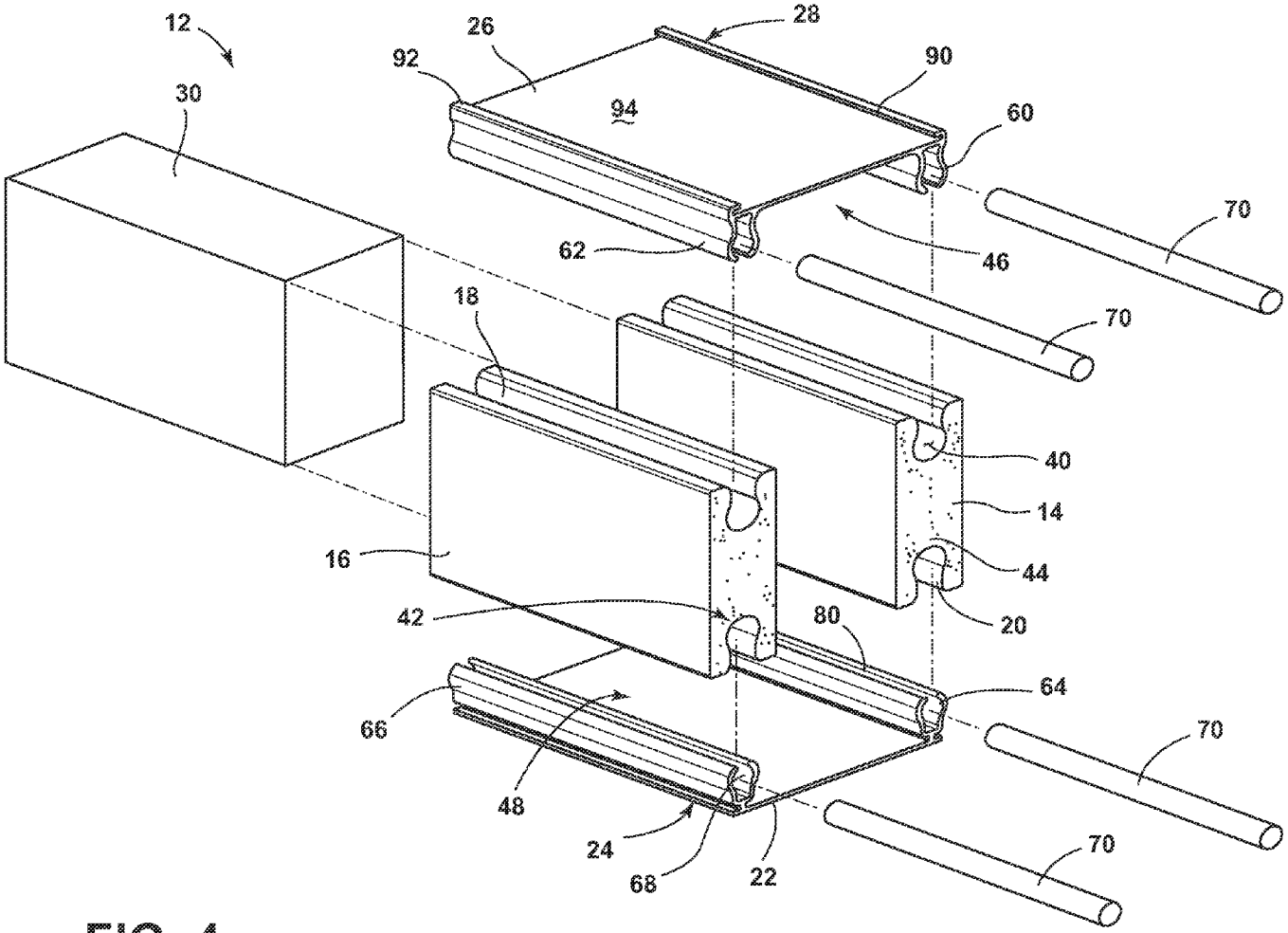
FIG. 4 is an exploded perspective view of one unit of an embodiment of the block system.
Figure 5:
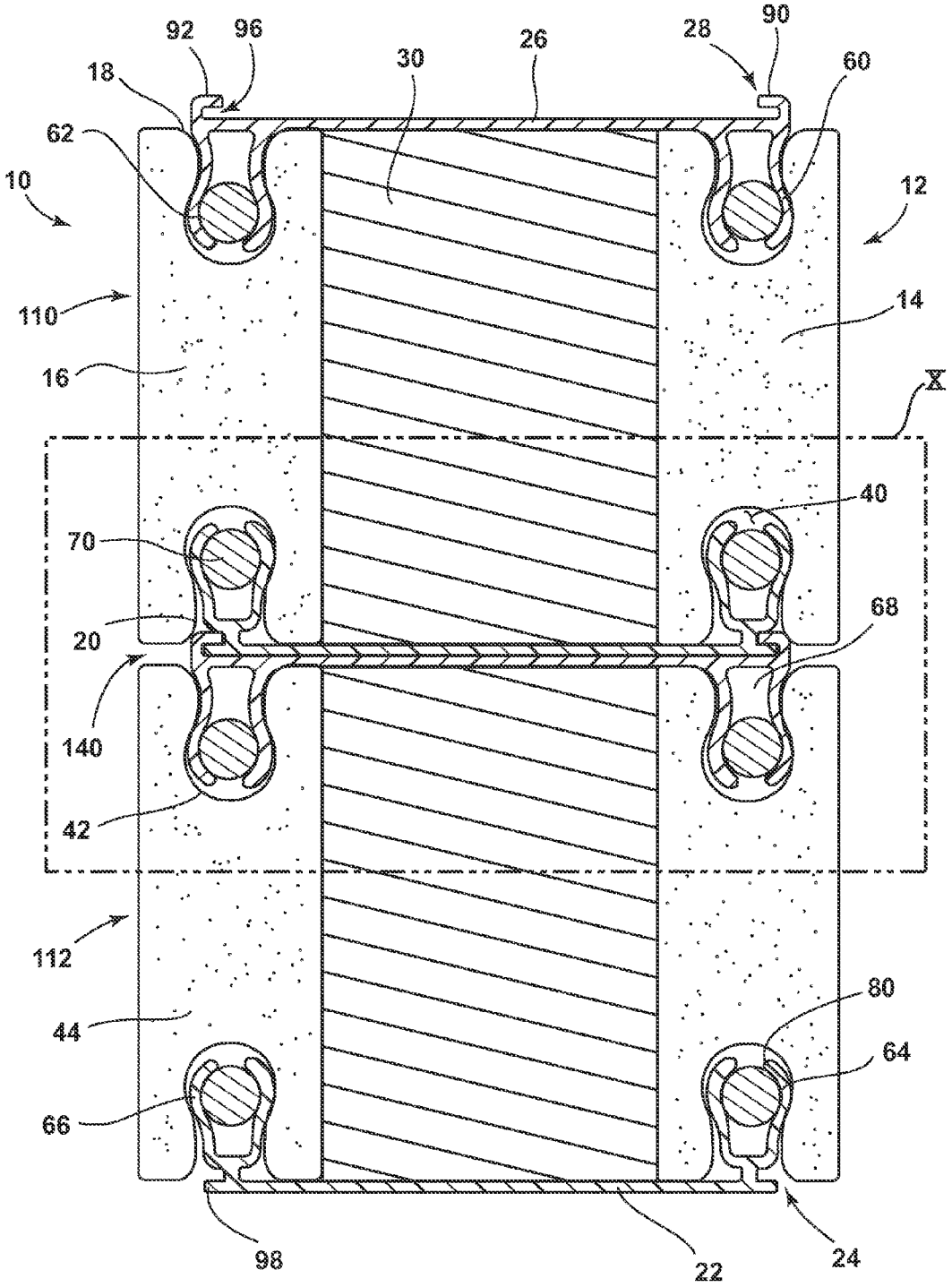
FIG. 5 is a cross-sectional view of an embodiment of two interlocking block modules of FIG. 1, taken along line V-V.
Figure 6:
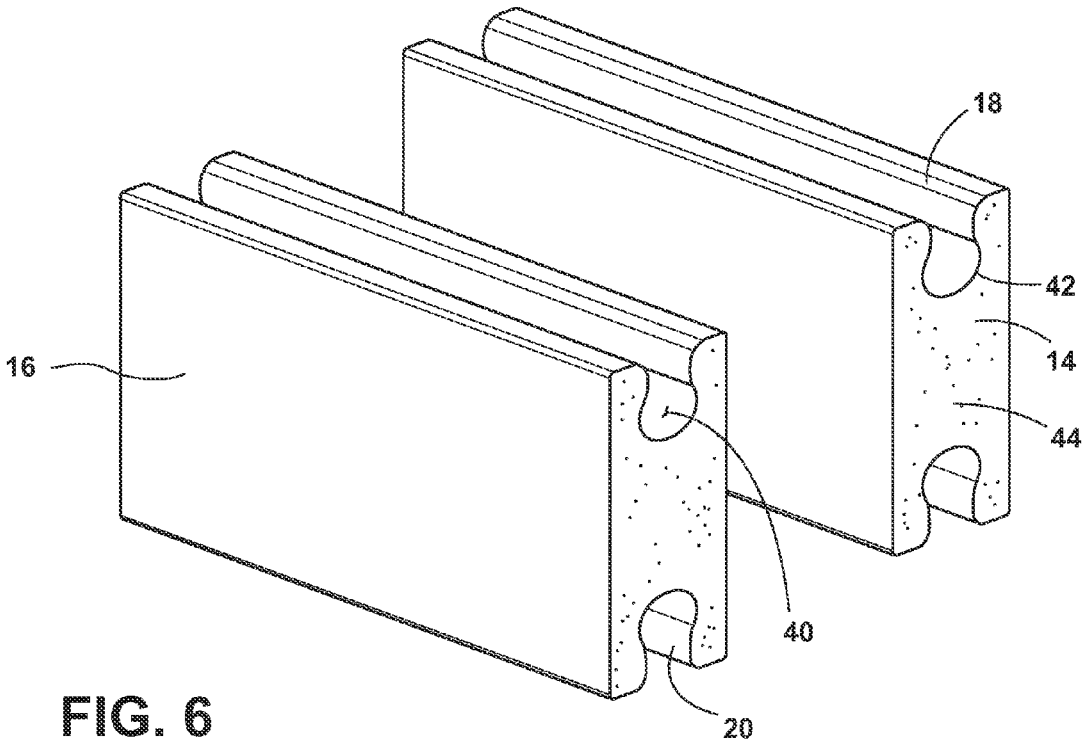
FIG. 6 is a perspective view of inner and outer structural members of another embodiment of the block system.
Figure 7:
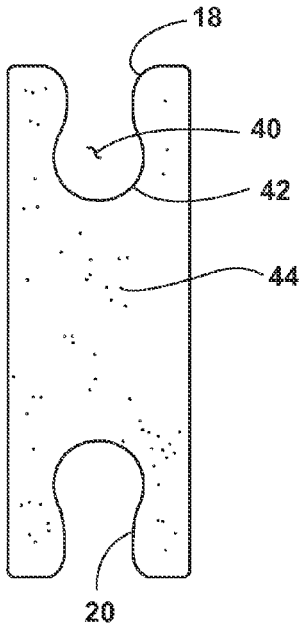
FIG. 7 is an end elevational view of one of the structural members of FIG. 6.
Figure 8:
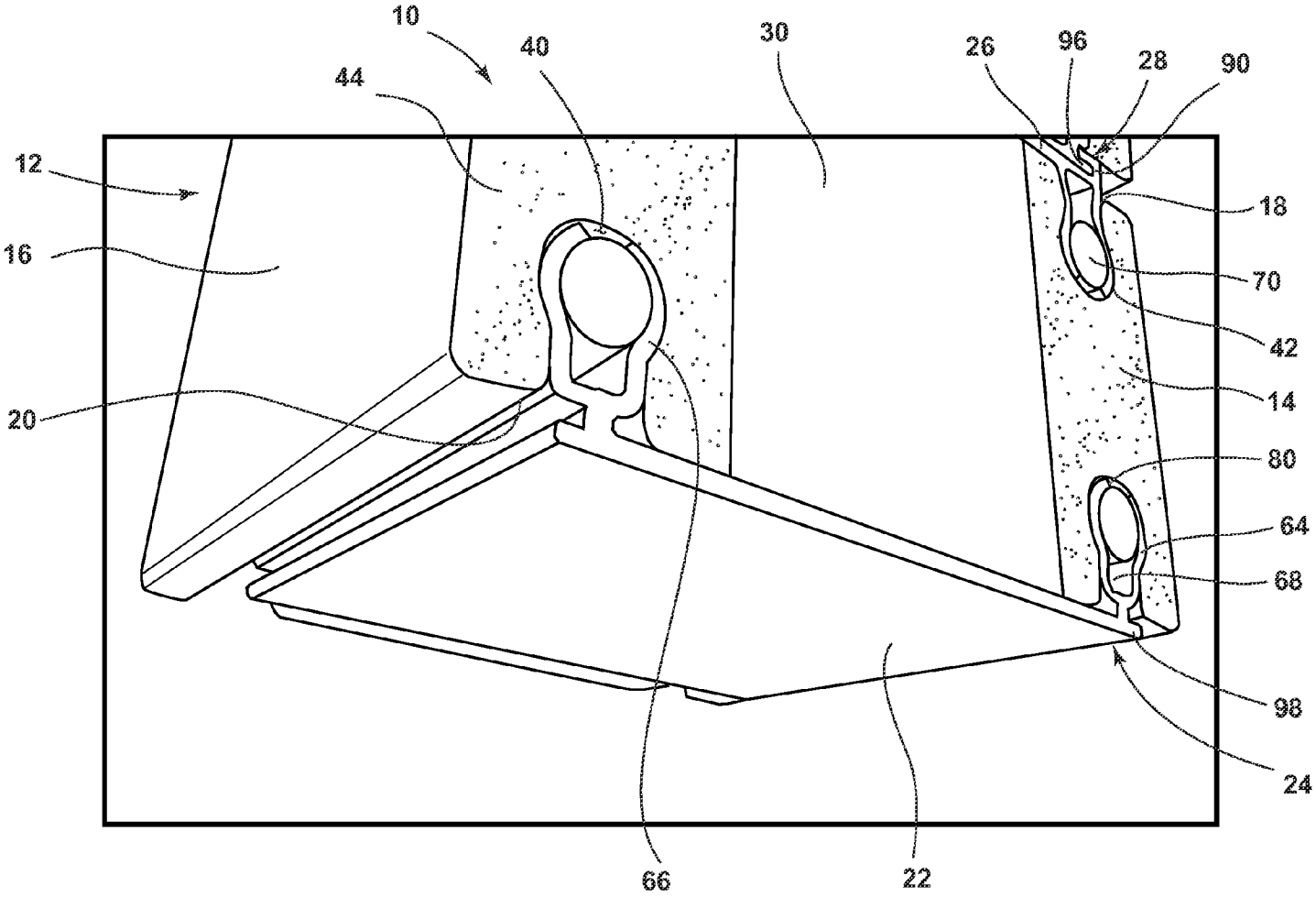
FIG. 8 is an enlarged perspective view of the bottom spanning panel of another aspect of the block module of FIG. 5.
Figure 9:
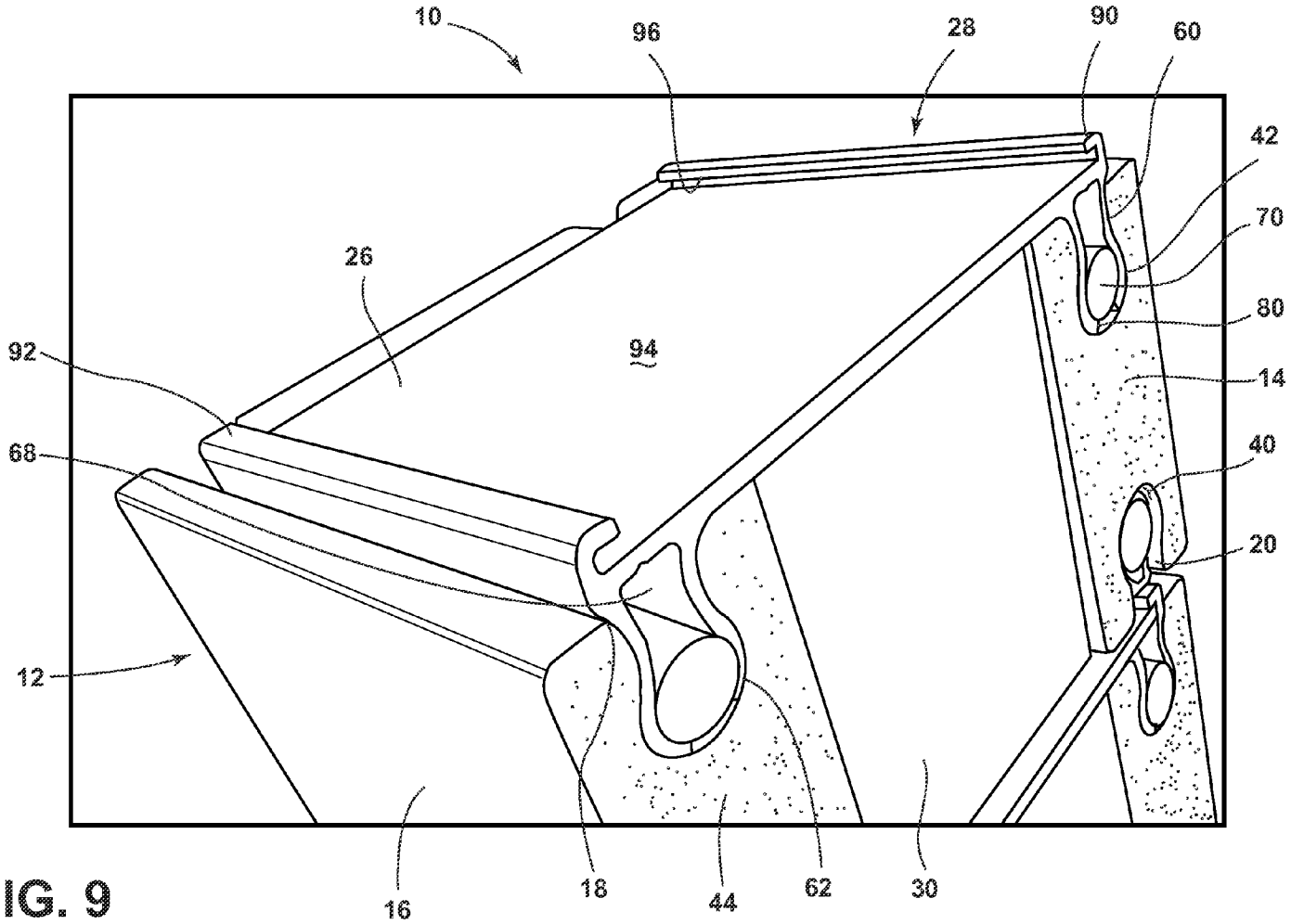
FIG. 9 is a detail perspective view of an embodiment of the top spanning panel of the mortarless block module of FIG. 8.
Figure 10:
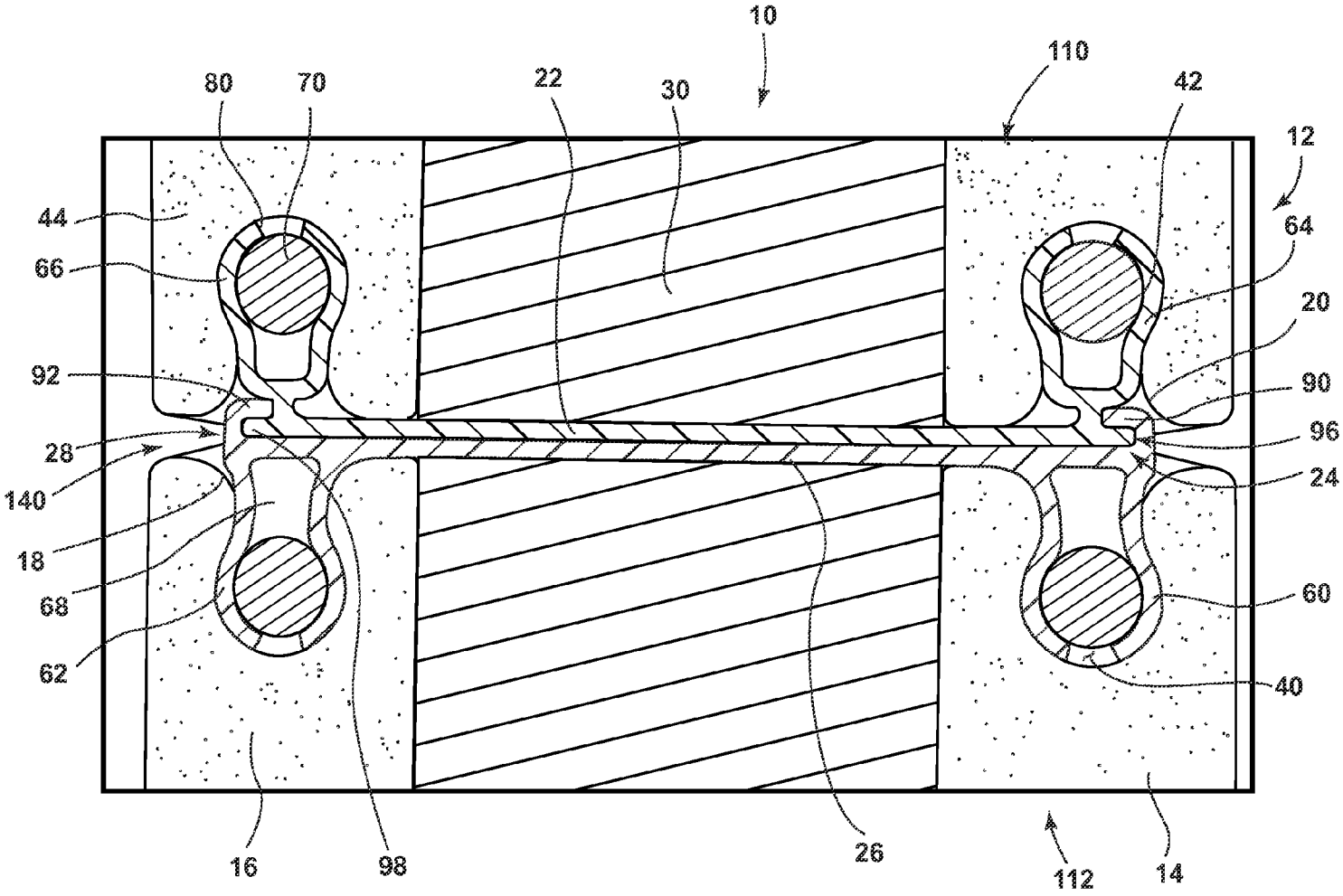
FIG. 10 is a detail cross-sectional view of the engagement between the top and bottom spanning panels of the block system of FIG. 5.
Figure 11:
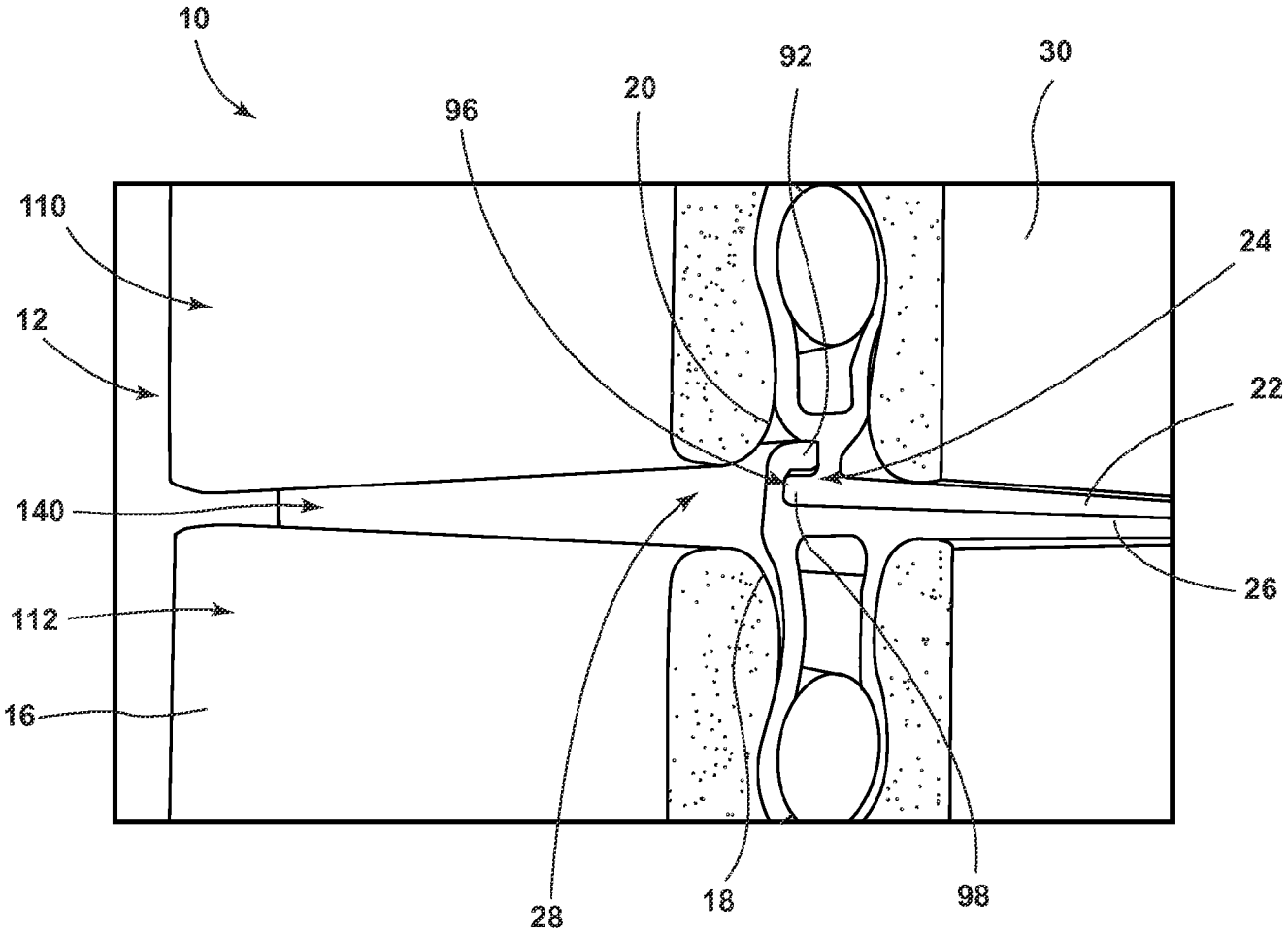
FIG. 11 is a detail perspective view of an alternate embodiment of the modular block system showing a connecting joint between two block modules.
Figure 12:
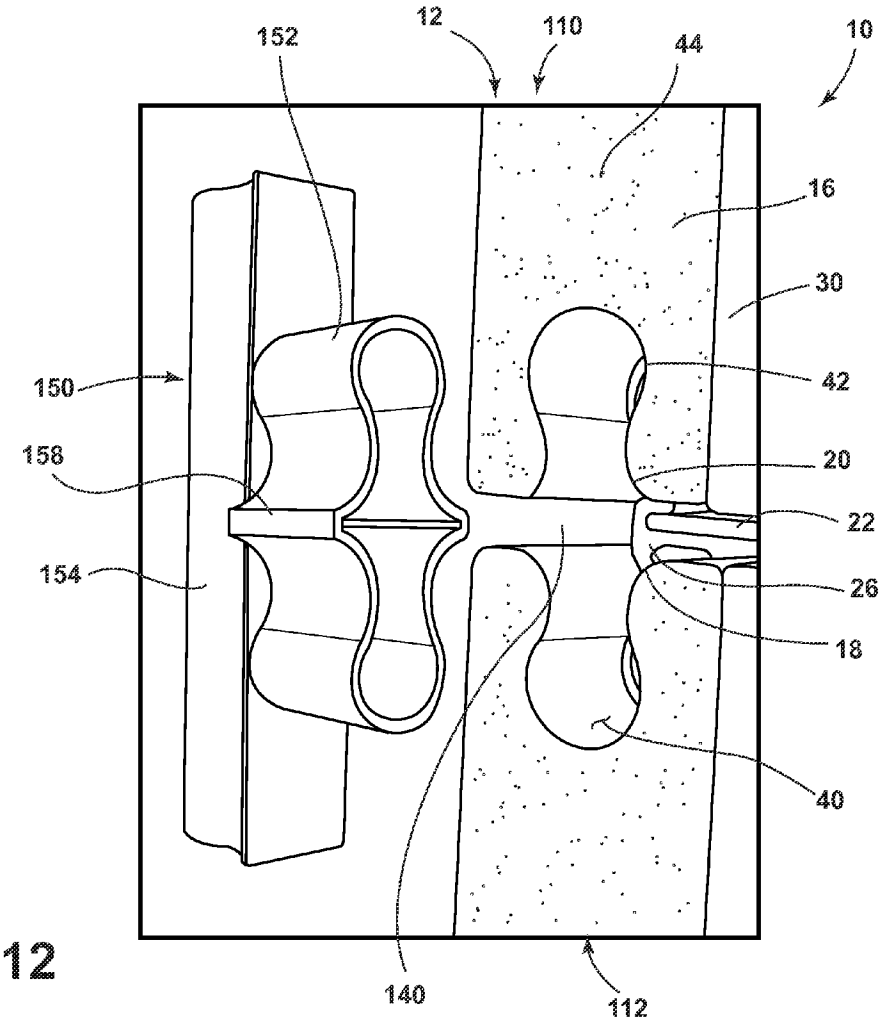
FIG. 12 is a partially exploded perspective view of the corner adapter removed from two engaged block modules.
Figure 14:
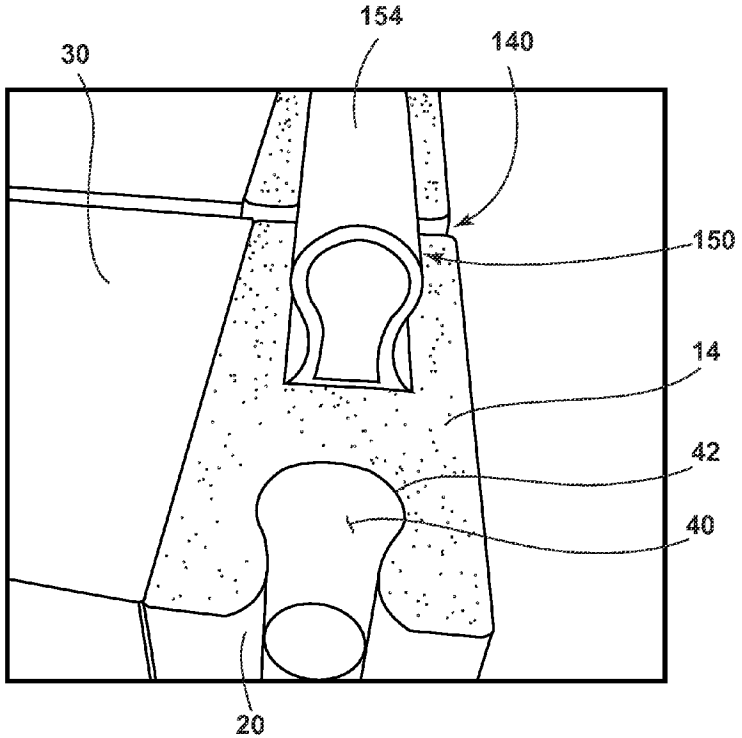
FIG. 14 is a second perspective view of the corner adapter of FIG. 13.
Figure 13:
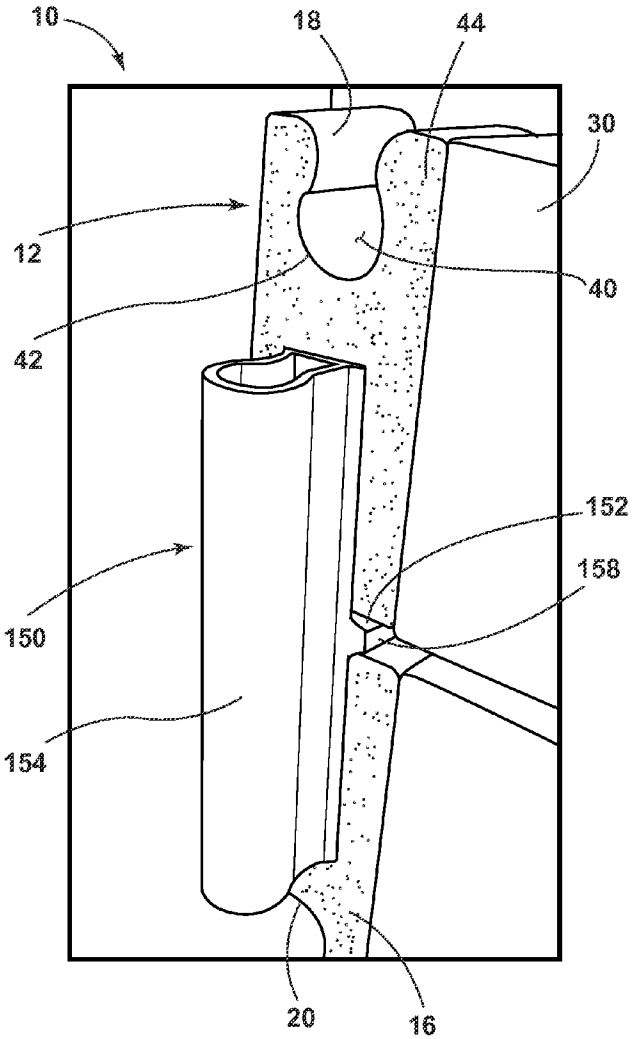
FIG. 13 is a perspective view of a corner adapter for an embodiment of the modular block system.
Figure 15:
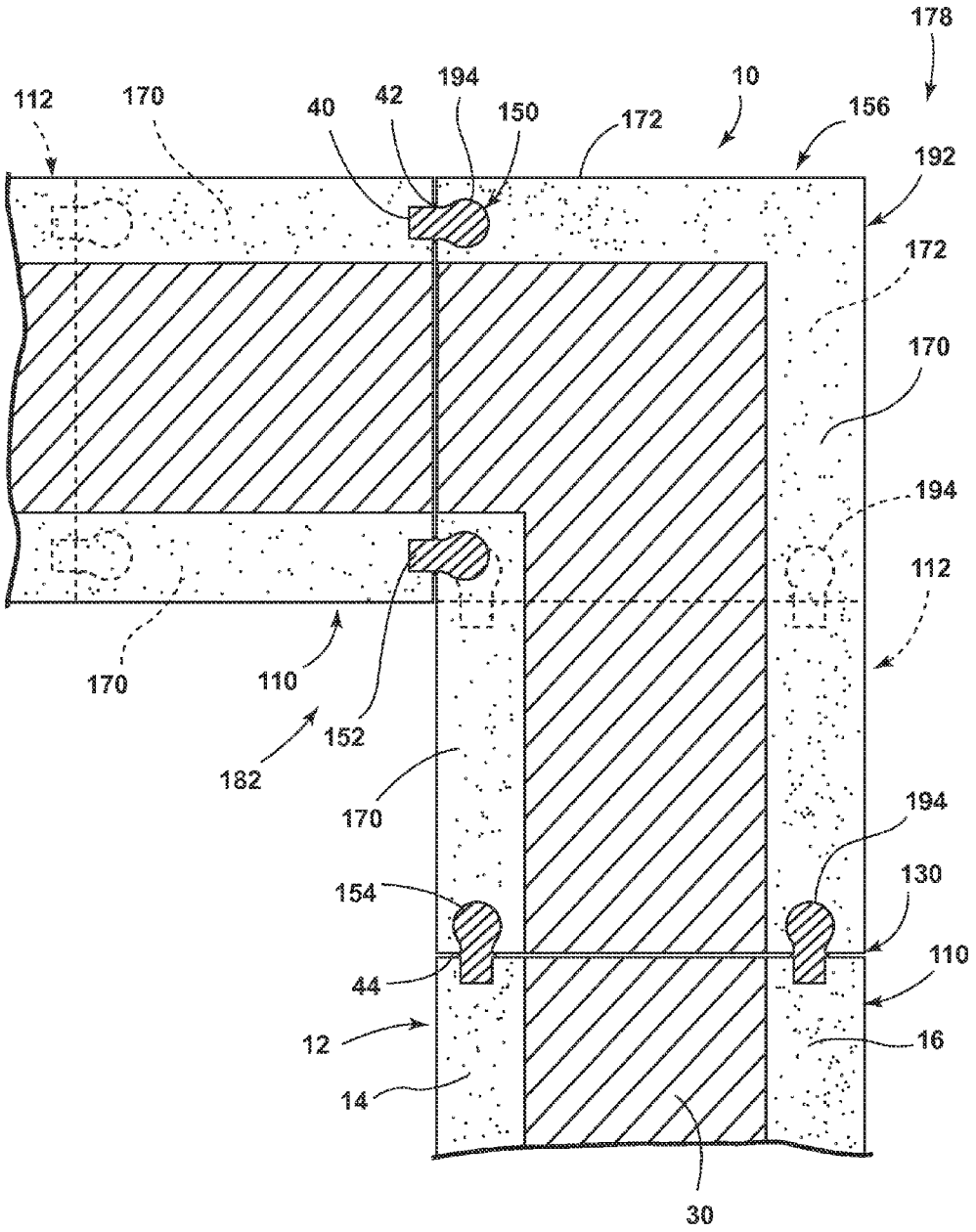
FIG. 15 is a lateral cross-sectional view of an alternate embodiment of the modular block system taken through a corner condition.
Figure 16:
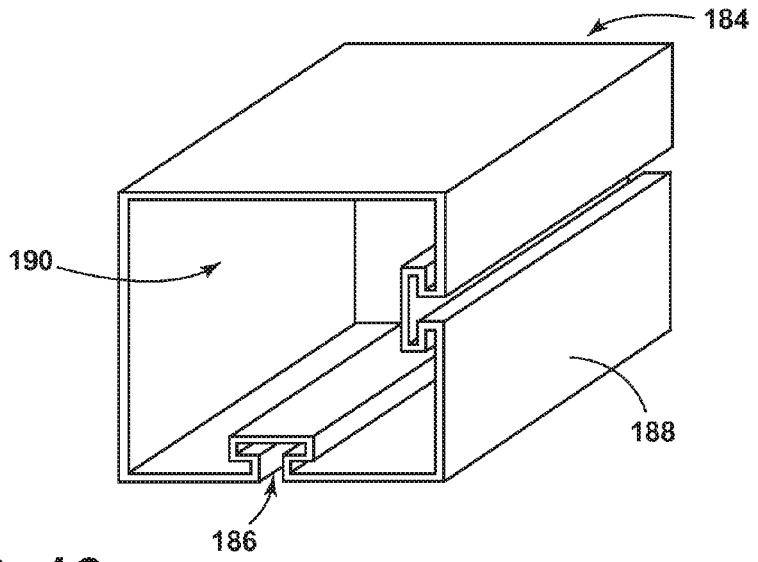
FIG. 16 is a bottom perspective view of one embodiment of a flange receiver for a corner condition of the modular block system.
Figure 17:
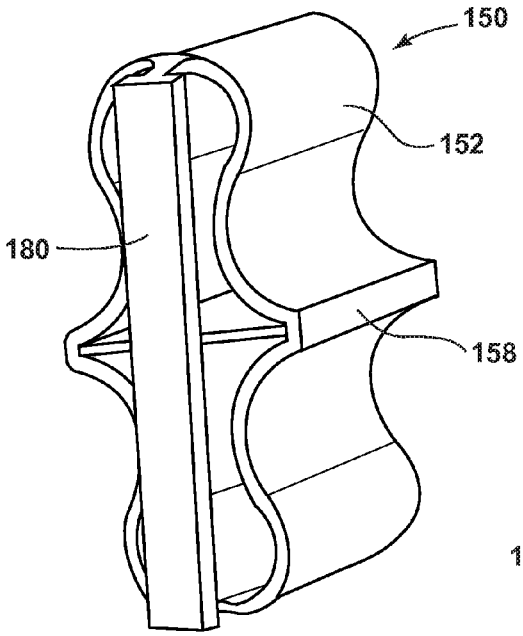
FIG. 17 is a perspective view of an alternate corner adapter for use with the flange receiver of FIG. 16.
Figure 18:
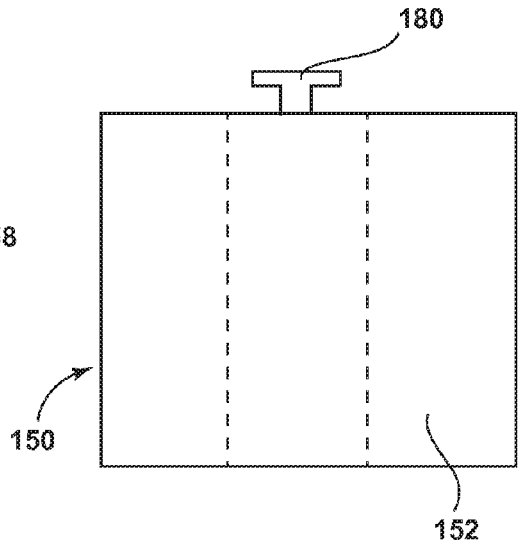
FIG. 18 is a top plan view of the corner adapter of FIG. 17.
Figure 19:
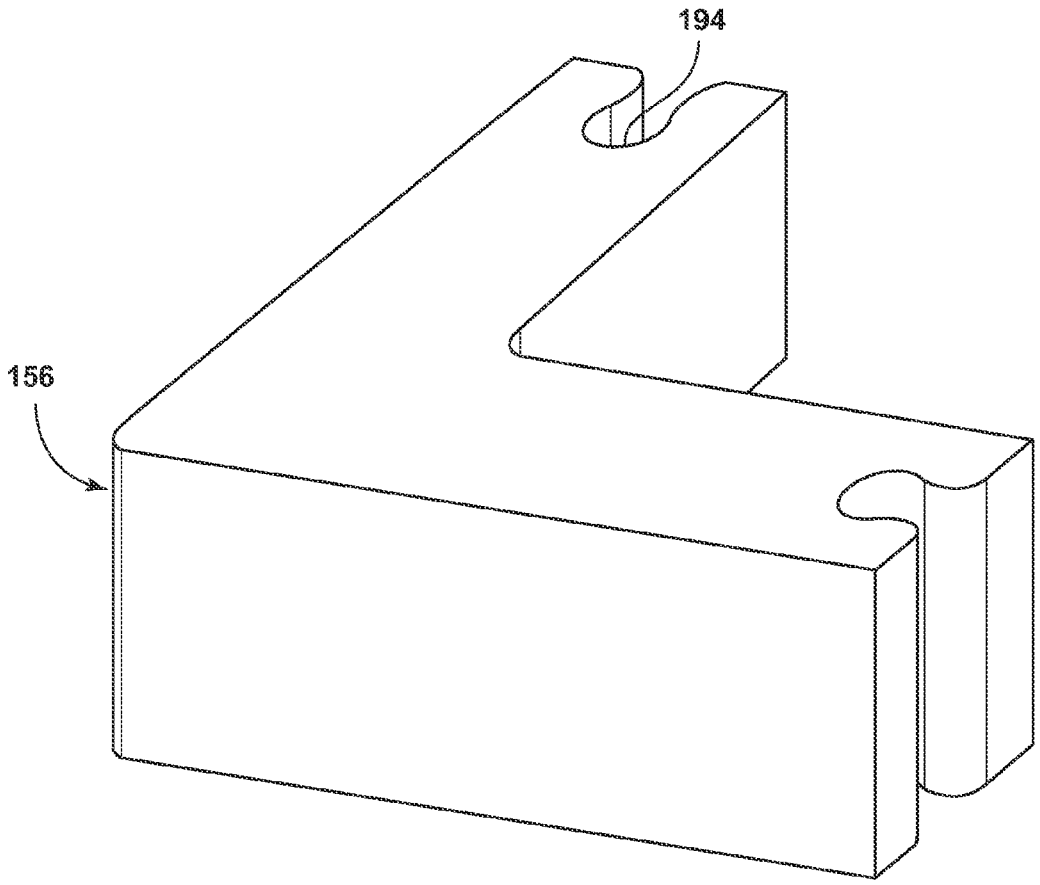
FIG. 19 is a top perspective view of a corner block for use in a corner condition of at least one embodiment of the modular block system.

Referring now to FIGS. 1-3, in assembling the various block modules 12 of the mortarless modular block system 10, the block modules 12 are placed within various courses, or horizontal layers of block modules 12, where each higher course 110 is placed upon the previously laid lower course 112 that is disposed below it. In this manner, each course, which represents a horizontally-extending layer of block modules 12, are stacked upon one another to form a wall system. The first course 114 can be laid upon some foundation 116, such as a foundation wall, concrete slab, or directly upon the ground. Regardless of the foundation 116, the first course 114 of block modules 12 can be disposed upon a wood sill plate 108 or modular receiving plate 118 or some other sill member. In various embodiments, the modular receiving plate 118 can include first and second engagement rails 90, 92 similar to that of the second retaining feature of one of the block modules 12. The first and second engagement rails 90, 92 can engage the first retaining feature 24 of the bottom spanning members 22 of the block modules 12 of the first course 114. In an alternate embodiment, the modular receiving plate 118 can include a first pair of upwardly extending securing members 60 that is adapted to engage inner and outer structural members 14, 16 of one of the block modules 12 within the first course 114. In constructing the first course 114, the modular receiving plate 118 can include a sill aperture for receiving aligning members that may extend from the foundation 116, where such aligning members can include, but are not limited to, lag bolts, lag screws, rebar, and other similar aligning members. In various embodiments, the modular receiving plate 118 and/or the block modules 12 of the first course 114 can be secured to the foundation 116 through various attachment features that include, but are not limited to, screws, lag screws, bolts, adhesives, combinations thereof and other similar attachment features.

In various embodiments, in order to secure the first course 114 to the foundation 116, the first course 114 can include a retaining compound or other similar retaining material, such as mortar, epoxy, adhesive, or other similar material, disposed between the inner and outer structural members 14, 16 to substantially retain the first course 114 to the aligning member. In such an embodiment, it is contemplated that the first course 114 of block modules 12 can be assembled on site rather than preassembled off site, such as in a factory setting or other assembly location. It is also contemplated that the bottom spanning member 22 can be attached, adhered, or otherwise connected directly to the foundation 116 without the use of aligning members within the foundation 116, as described above. In such an embodiment, there may be little need to assemble on site any of the courses of block modules 12. Alternatively, in various embodiments, mortar may be used to substantially secure a first course 114 of block modules 12 to the sill plate or to a foundation 116 or to aligning members of a foundation 116. In such embodiments, the insulation member 30 disposed within the interior volume defined between the inner and outer structural members 14, 16 and the bottom and top spanning members 22, 26 may be filled at least partially with mortar to secure the block module 12 to the foundation 116. Similar mortar-filled block modules 12 may be used to create lintels over windows, doors, archways, or other openings in the structural wall.

In the various embodiments, a similar modular receiving plate 118 can be used for lintels, spanning members, or other bottom courses within a masonry wall. It is also contemplated that the mortarless modular block system 10 can include a modular top plate adapted to engage upper retaining grooves 18 or the top spanning member 26 of a higher course 110 of the masonry wall. Such higher courses 110 can be found at window sills, the tops of walls or other areas where no additional courses will be laid.

In the various embodiments, where a wood sill plate is used to support the first course 114 of block modules 12, a receiving plate 118 can be directly attached to the wood sill plate. The receiving plate 118 can be substantially similar to the top spanning member 26 with a structure similar to the second retaining feature 28 included thereon. The second retaining feature 28 of the receiving plate 118 is configured to receive the first retaining feature 24 of the bottom spanning member 22 of each block module 12 of the first course 114. In the various embodiments, the receiving plate 118 can be free of any securing members and can be attached to the wood sill plate by various features and/or adhesives that include, but are not limited by, bolts, screws, nails, epoxy, drying adhesive, curing adhesive, multi-part adhesive and others. In the various embodiments, the receiving plate 118 can include an at least partially solid member with the second retaining feature 28 defined therein.

Referring again to FIGS. 1-3, after at least a portion of the first course 114 is placed upon the foundation 116, or a lower course 112 is laid, the higher course 110 of block modules 12 can be slidably engaged onto the lower course 112. The bottom spanning member 22 of the higher course 110 of block modules 12 can be slidably engaged with the top spanning member 26 of the lower course 112 of block modules 12. In aligning the higher course 110 of block modules 12 with the lower course 112 of block modules 12, the higher course 110 is generally offset with respect to the lower course 112. In this manner, vertical seams 130 that extend between two laterally adjacent block modules 12 extend only through a single course. The misalignment of the vertical seams 130 between laterally adjacent block modules 12 also serves to provide a self-leveling function of the mortarless modular block system 10, as will be described below.

Referring again to FIGS. 1-3, when the second retaining feature 28 of one of the block modules 12 within the lower course 112 is slidably engaged to the first retaining feature 24 of the bottom spanning member 22 of the higher course 110, the slidable engagement between the two block modules 12 substantially secures, structurally secures, and vertically and laterally aligns the vertically adjacent block modules 12 together. This connection can be substantially free of mortar, such that the engagement between the first and second retaining features 24, 28 properly aligns and secures each of the plurality of block modules 12. As discussed above, because the vertical joints between the laterally adjacent block modules 12 are misaligned, a block module 12 disposed on a higher course 110 will engage two block modules 12 within the course immediately below. In this manner, the various block modules 12 within the higher course 110 can only be engaged with the two vertically adjacent block modules 12 of the lower course 112 if the two vertically adjacent block modules 12 are vertically and horizontally aligned with one another. In this manner, the first retaining features 24 within the higher course 110 can slidably engage the second retaining features 28 of the two laterally adjacent block modules 12 in the lower course 112. In addition, when the block modules 12 of the higher course 110 engage the block modules 12 of the lower course 112, the various block modules 12 are also leveled relative to one another such that the first and second retaining features 24, 28 of the block modules 12 of the lower and higher courses 110 can slidably engage and properly align one another. Accordingly, if two laterally adjacent block modules 12 are out of vertical, horizontal, or level alignment, the block module 12 within the higher course 110 will be unable to slidably engage both of the laterally adjacent block modules 12 within the lower course 112, until such time as proper alignment is achieved. This self-leveling characteristic of the mortarless modular block system 10 substantially ensures that the block modules 12 placed in higher courses 110 are in proper alignment with the block modules 12 previously laid in a lower course 112. The end result of the assembly of the various block modules 12 of the mortarless modular block system 10 is a monolithic masonry wall that is properly aligned and structurally sound through the engagement of the various first and second retaining features 24, 28 within each of the plurality of block modules 12.

Referring again to FIG. 1, it is contemplated that the size of the plurality of block modules 12 can be consistent, such that each block module 12 is substantially the same size. It is contemplated that the size of each block module 12 can be within the range of about 4" high and about 8" long and about 8" deep, but can also be larger or smaller depending upon the application and the desired aesthetic effects of the wall structure to be built. Accordingly, the mortarless modular block system 10 can be adapted to create a wide variety of bond patterns that can include, but are not limited to, running bond, common bond, Flemish bond, Monk bond, Sussex bond, and other similar bond patterns. In various alternate embodiments, each block module 12 of the mortarless modular block system 10 can be sized similar to a cinder block for applications requiring larger block modules 12. Each block module 12 can be made to include an aesthetic face that is designed to be exposed. Such aesthetic face conditions can include split-face, smooth, textured, colored, various geometric or irregular patterns and/or reliefs, as well as other aesthetic finishes.

In various embodiments, exposed portions of the top and bottom spanning members 26, 22 can also include finished aesthetic surfaces. By way of explanation and not limitation, the first and second engagement rails 90, 92, which may be exposed between the horizontal joints 140 of two vertically adjacent block modules 12, can include an aesthetic finish.

The finished aesthetic surface can include colors, textures, shapes, reliefs, and other aesthetic treatments.

Referring now to FIGS. 12-15, in order to produce corner conditions 178 within the mortarless modular block system 10, a plurality of corner adapters 150 can be included within the mortarless modular block system 10. In the various embodiments, the corner adapter 150 can include a wall engagement portion 152 that is adapted to be inserted within the expanded inner portions 40 of two vertically adjacent block modules 12. The wall engagement portion 152 is adapted to substantially fill a portion of each of the two expanded inner portions 40 and can include a spacer portion 158 that fits at least partially within the horizontal joint 140 between the two vertically adjacent block modules 12. In various embodiments, the expansion members 70 can be inserted into the wall engagement portions 152 to substantially fix the corner adapter 150 within the two expanded inner portions 40. The corner adapter 150 can also include an adapter portion 154 that is adapted to receive a corner block 156 that slides vertically down the adapter portion 154 of the corner adapter 150 to complete the corner between two joining wall sections that are disposed at different angles from one other. It is contemplated that the corner section can be disposed at a right angle to account for the majority of masonry wall connecting points. It is also contemplated that the corner portion of the mortarless modular block system 10 can include a variety of systems to account for acute or obtuse angles between two adjoining masonry walls.

In various embodiments, it is contemplated that two vertically adjacent corner blocks 156 of the mortarless modular block system 10 can include long and short extensions 170, 172 having different lengths. In assembling the various corner blocks 156, the corner blocks 156 can be installed to connect with the adjoining masonry walls such that the locations of the long and short extensions 170, 172 of the corner block 156 vertically alternate such that no single vertical seam 130 extends more than one course through the wall constructed with the mortarless modular block system 10. Accordingly, each corner block 156 can include a long extension 170 and a short extension 172 set at a different angle than the long extension 170. After a first corner block 156 is laid to adjoin two adjacent wall portions, a second corner block 156 is laid upon the first corner block 156 such that the short extension 172 rests upon the long extension 170 of the first corner block 156 and the long extension 170 of the second corner block 156 lies upon the short extension 172 of the first corner block 156.

Referring now to FIGS. 16-21, an alternate corner condition 178 is described herein. According to various embodiments, the corner adapter 150 can include a vertical flange 180 that extends outward from an end wall 44 of the block module 12 that engages the corner condition 178. The vertical flange 180 can extend substantially the entire height of the corner adapter 150, the entire full height or greater than the full height of the corner adapter 150. Accordingly, the vertical flange 180 can be configured to engage two vertically adjacent block modules 12 that are within the corner condition 178. It is contemplated that the corner adapter 150 having a vertical flange 180 is typically disposed proximate the inner corner condition 182, generally where two inner structural members 14 of adjacent block modules 12 meet at the corner condition 178. In this manner, a flange receiver 184 can be disposed at the inner corner condition 182 to receive two vertical flanges 180 that extend from the inner structural members 14 of the adjacent block modules 12. It is contemplated that the flange receiver 184 includes two flange slots 186, each of which is adapted to receive a separate vertical flange 180 from adjacent wall portions of the modular block system 10.

Referring again to FIGS. 16-21, when two adjacent wall portions are positioned adjacent one another at a predetermined angle, the corner condition 178 can be constructed by placing corner adapters 150 within the inner structural members 14 of the block modules 12 of the adjacent wall portions. Once the corner adapters 150 having the vertical flanges 180 are in position, the flange receiver 184 can be slidably engaged with the vertical flanges 180 of the adjacent corner adapters 150. In this manner, the flange receiver 184 can at least partially secure the adjacent block modules 12 of the two adjoining wall portions. According to various embodiments, the flange receiver 184 can include a plurality of angular configurations such that flange slots 186 defined within receiver walls 188 of the flange receiver 184 can be set at varying angles to receive the block modules 12 of wall portions that may meet at non-perpendicular angles. It is also contemplated that the flange receiver 184 can include more than two flange slots 186 defined within various receiver walls 188 of the flange receiver 184. In this manner, three or more adjacent wall portions that meet at a particular corner condition 178 can be joined together by the engagement of the flange receiver 184 and the vertical flanges 180 of the various corner adapters 150 that are disposed at the corner condition 178.

Figure 20:
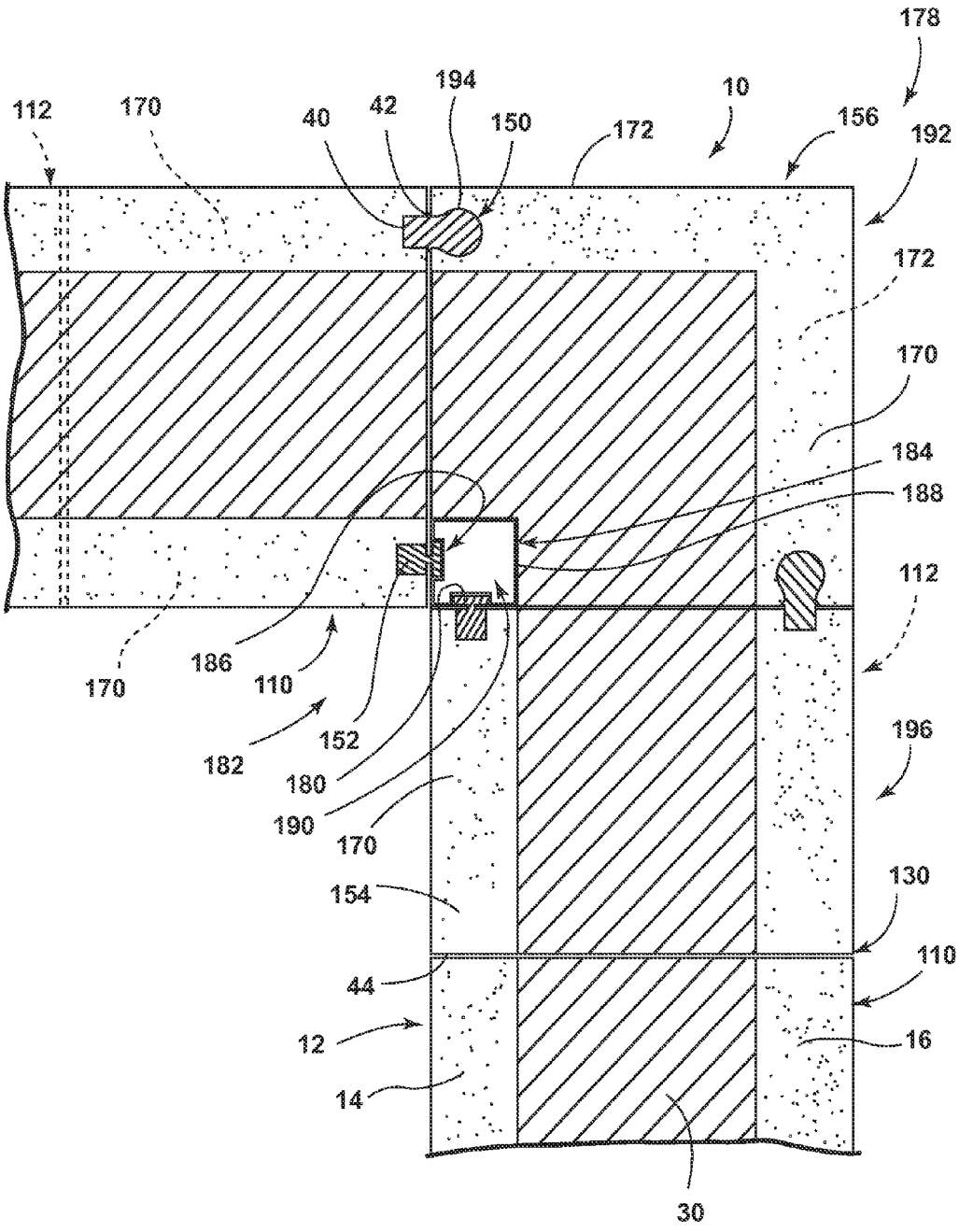
FIG. 20 is a top plan view an assembled corner condition of a block wall using an embodiment of the modular block wall system.
Figure 21:
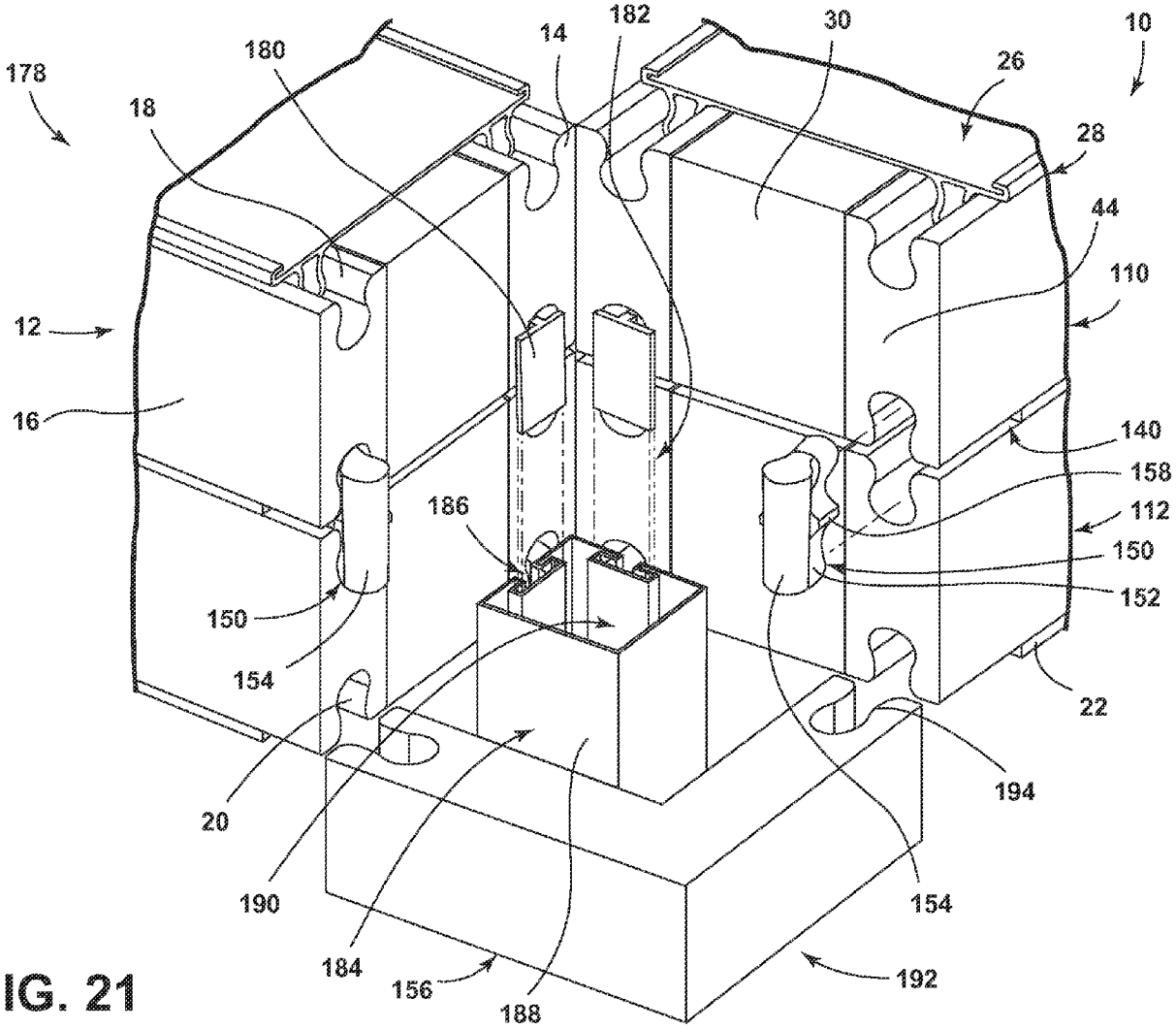
FIG. 21 is a partially exploded perspective view of the corner condition of FIG. 20.

As illustrated in the embodiment of FIG. 20, the adjacent wall portions that define the corner condition 178 where the flange receiver 184 and the vertical flange 180 of the corner adapter 150 engage, the end walls 44 of each of the block modules 12 are substantially co-planar throughout the height of the wall portion. Accordingly, a plurality of flange receivers 184 can be stacked vertically upon one another, as the various higher courses 110 of the modular block system 10 are assembled. According to various embodiments, it is contemplated that once the adjacent wall portions of the modular block system 10 are complete, a single flange receiver 184 having substantially the same height as the adjacent wall portions of the corner conditions 178 can be slidably engaged with each of the vertical flanges 180 of the various corner adapters 150. By sliding the single flange receiver 184 downward and in progressive slidable engagement with the various vertical flanges 180 disposed within the block modules 12. A single flange receiver 184 can engage all of the vertical flanges 180 of the corner condition 178. It is also contemplated that long sections of the flange receivers 184 that vertically extend across multiple block modules 12 within the wall portion can be installed to form at least a portion of the corner condition 178. It is also contemplated that once the one or more flange receivers 184 are disposed within the corner condition 178 to substantially secure the various block modules 12 at the corner condition 178, a structural member can be inserted through a cavity 190 defined by the receiver walls 188 of the flange receiver 184 to provide additional structural support to the flange receiver 184 when engaging the various block modules 12 of the modular block system 10. Such reinforcing members can include, but are not limited to, steel, structural adhesives, epoxy, cement-type materials, wood, combinations thereof, or other substantially structural material that can be inserted within the cavity 190 defined by the one or more flange receivers 184. In various alternate embodiments, it is contemplated that the cavity 190 of the flange receiver 184 can be filled with spray foam or other insulating material.

Referring again to FIGS. 19-21, while the flange receiver 184 is disposed at an inner corner condition 182 of the corner condition 178, an outer corner block 156, as substantially described above, can be used to provide structural support for the outer portion 192 of the corner condition 178. In this manner, as the outer corner block 156 is disposed at the outer portion 192 of the corner condition 178, corner adapters 150 are configured to slidably engage the end walls 44 of the various block modules 12 disposed within the adjoining wall portions. The adapter portion 154 of the corner adapter 150 is then slidably engaged with the adapter ends 194 of the corner block 156 that include recesses having a shape that matingly engages the adapter portions 154 of the corner adapters 150.

Referring again to FIG. 20, as discussed above, the end walls 44 of the various block modules 12 positioned at the ends of the wall portions that define the corner condition 178 are substantially vertical. As such, because the various block modules 12, as the courses are created, are vertically staggered, half-size block modules 196, or fractional-size block modules are necessary in order to complete the wall portion to form the corner condition 178 that the corner adapters 150, flange receivers 184, and corner blocks 156 can be installed within. These half-size block modules 196, or partial blocks, can be built in substantially the same manner as that of the full-size block modules 12 described above, with the exception that the half-size block modules 196, or partial blocks, have a decreased length to account for the staggered placement of the various block modules 12.

Figure 22:
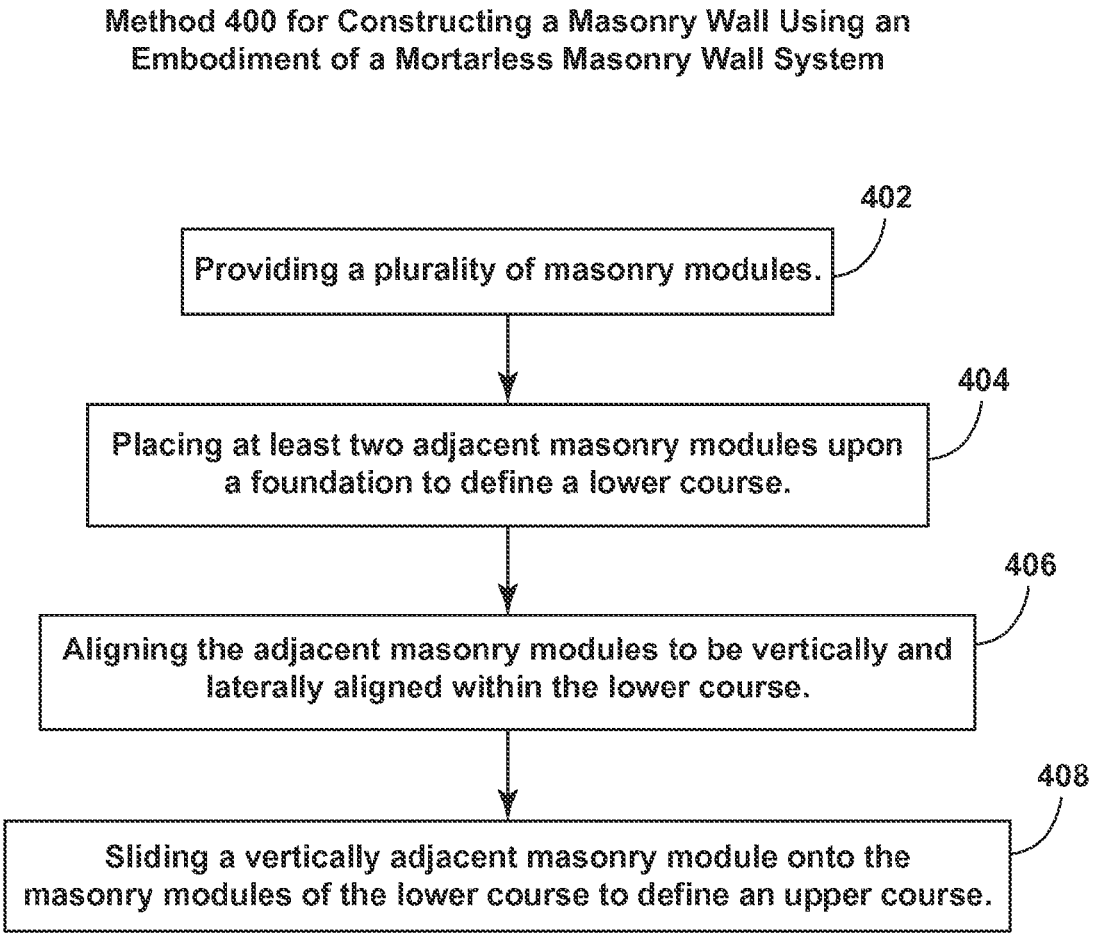
FIG. 22 is a schematic flow diagram illustrating a method for constructing a wall using an embodiment of the block system.

Referring now to FIG. 22, having described the mortarless modular block system 10 and the construction of the individual block modules 12, a method 400 is disclosed for constructing a wall using an embodiment of a mortarless modular block system 10. A first step of the method 400 includes providing a plurality of block modules 12 (step 402). Each of the plurality of block modules 12 includes inner and outer structural members 14, 16, with each of the inner and outer structural members 14, 16 including upper and lower retaining grooves 18, 20. A bottom spanning member 22 extends the length of the inner and outer structural members 14, 16, wherein the second pair of securing members 48 of the bottom spanning member 22 are configured to be retained within the lower retaining grooves 20 of the inner and outer structural members 14, 16. The bottom spanning member 22 also includes a first retaining feature 24. Each of the plurality of block modules 12 also includes a top spanning member 26 that extends the length of the inner and outer structural members 14, 16. The first pair of securing members 46 of the top spanning member 26 are configured to be retained within the upper retaining grooves 18 of the inner and outer structural members 14, 16 with the top spanning member 26 including a second retaining feature 28 that cooperates with a first retaining feature 24 of the bottom spanning member 22 of an adjacent block module 12. An insulation member 30 is also disposed within an interior volume of each of the block modules 12 that is defined by the inner and outer structural members 14, 16 and the top and bottom spanning members 26, 22 of each of the block modules 12. As discussed above, the exact construction of each of the block modules 12 can vary as discussed in the embodiments described herein. Additionally, each of the block modules 12, or a portion of the block modules 12, is intended to be manufactured and assembled off site. However, each block module 12, if necessary, can be constructed on site depending upon the exact needs of the construction project.

Referring again to FIG. 22, the method 400 includes the step of placing at least two adjacent block modules 12 upon a foundation 116, or upon a lower course 112 of block modules 12 units (step 404). As discussed above, when a course of block modules 12 is placed upon a foundation 116, the block modules 12 can be attached to the wood sill plate of the foundation 116 via receiving plates 118 that extend upward from the foundation 116. Alternatively, the block modules 12 of the lower course 112 can be disposed upon the wood sill plate of the foundation 116 via some form of adhesive that can include, but is not limited by, epoxy, silicone, or some other form of adhesive. The lower course 112 of block modules 12 can also be attached to the wood sill plate of the foundation 116 via various mechanical fasteners that can include, but are not limited to, ties, straps, bolts, lags, and other various mechanical fasteners. It is also contemplated that these mechanical fasteners can be used to attach the receiving plate 118 to a sill plate secured to the foundation 116.

As illustrated in FIG. 22, once the two adjacent block modules 12 are placed upon the foundation 116, another step in the method 400 includes aligning the at least two adjacent block modules 12 to be vertically and laterally aligned within the lower course 112 (step 406). As discussed above, a higher course 110 of block modules 12 can only be slidably engaged with the two block modules 12 of the lower course 112 if each of the block modules 12 of the lower course 112 is vertically and laterally aligned. Once properly aligned, the first and second retaining features 24, 28 of the block modules 12 of the higher and lower courses 110, 112 can slidably engage with one another. In this manner, the mortarless modular block system 10 is a self-leveling system that causes proper alignment of the various block modules 12 through their slidable engagement with one another. Where block modules 12 are out of vertical or lateral alignment, or both, subsequent courses of block modules 12 are prevented from being slidably engaged with the lower course 112, until such time as proper vertical and lateral alignment is achieved between the block modules 12 of the lower course 112.

Referring again to FIG. 22, another step in the method 400 includes sliding a vertically adjacent block module 12 onto the at least two block masonry modules 12 within the lower course 112 that have been properly aligned (step 408). The vertically adjacent block module 12 defines the location of the higher course 110 on top of the lower courses 112. In this manner, the first and second retaining features 24, 28 of the vertically adjacent block modules 12 slidably engage one another such that the block module 12 of the higher course 110 can be located in relation to the block modules 12 of the lower course 112. Accordingly, when the block module 12 of the higher course 110 is positioned in relation to the block modules 12 of the lower course 112, the connection between the higher and the lower course 110, 112 creates a secure, structural and self-leveling connection that is free of the use of mortar. It should be noted that while the system can operate without the use of mortar, for aesthetic purposes or for weatherproofing purposes, certain mortar products can be used in conjunction with the mortarless modular block system 10.

Referring again to FIG. 22, another step in the method 400 includes inserting a corresponding expansion member 70 into a respective hollow interior portion 68 of the first, second, third and fourth securing members 60, 62, 64, 66 of the inner and outer structural members 14, 16, respectively. Each corresponding expansion member 70 is inserted through a corresponding securing aperture 42 disposed at ends of each of the expanding portions. The insertion of the corresponding expansion member 70 into each hollow interior portion 68 is configured to expand each of the corresponding first, second, third and fourth securing members 60, 62, 64, 66. In this manner, as the first, second, third and fourth securing members 60, 62, 64, 66 expand due to the insertion of the expansion member 70, the expansion causes a secure fit between the first, second, third and fourth securing members 60, 62, 64, 66 and the respective upper and lower retaining grooves 18, 20 of the inner and outer structural members 14, 16. It is contemplated that step 410 can be performed in an off-site manufacturing facility and can be performed as a step in manufacturing each block module 12 before delivery to the building site.

It is to be understood that variations and modifications can be made on the aforementioned structure without departing from the concepts of the present invention, and further it is to be understood that such concepts are intended to be covered by the following claims unless these claims by their language expressly state otherwise.

What is claimed is:

1. A block module for a modular block system, each block module comprising:

inner and outer structural members, wherein each of the inner and outer structural members includes upper and lower retaining grooves, wherein each of the upper and lower retaining grooves each include an expanded inner portion defined within each of the inner and outer structural members, wherein the expanded inner portion extends a length of each respective inner and outer structural member, wherein each expanded inner portion is accessible through a securing aperture disposed at an end of the expanded inner portion, wherein each securing aperture is defined within an end wall of a respective inner and outer structural member;

a bottom spanning member extending a length of the inner and outer structural members, wherein the bottom spanning member is configured to be retained within the lower retaining grooves of the inner and outer structural members, and wherein the bottom spanning member includes a first retaining feature;

a top spanning member extending the length of the inner and outer structural members, wherein the top spanning member is configured to be retained within the upper retaining grooves of the inner and outer structural members, and wherein the top spanning member includes a second retaining feature that is configured to cooperate with the first retaining feature of an adjacent block module wherein the top spanning member includes a first pair of securing members that are configured to be secured within the expanded inner portion of the upper retaining grooves of the inner and outer structural members, and wherein the bottom spanning member includes a second pair of securing members that are configured to be secured within the expanded inner portion of the lower retaining grooves of the inner and outer structural members, wherein the first and second pair of securing members are configured to position the inner and outer structural members at a predetermined distance; and an insulation member disposed within an interior volume defined between the inner and outer structural members and the top and bottom spanning members, wherein the insulation member is compressed between the inner and outer structural members, and wherein the top and bottom spanning members engage the upper and lower retaining grooves to exert a laterally inward compressive force against the inner and outer structural members to compress the insulation member between the inner and outer structural members and secure the inner and outer structural members, the top and bottom spanning members and the insulation member in a unitary member.

2. The block module of claim 1, wherein the insulation member is a solid piece of insulation.

3. The block module of claim 1, wherein the inner and outer structural members are masonry.

4. The block module of claim 1, wherein the top and bottom spanning members are made of plastic.

5. A modular block system comprising:

a plurality of block modules, each of the plurality of block modules including:

a) a top spanning panel including first and second securing members extending from opposite edges of the top spanning panel;

b) a bottom spanning panel including third and fourth securing members extending from opposite edges of the bottom spanning panel and extending toward the first and second securing members and a first retaining feature defined within the opposite edges of the bottom spanning panel;

c) an inner structural member extending perpendicularly between one of the first and second securing members and one of the third and fourth securing members;

d) an outer structural member extending perpendicularly between the other of the first and second securing members to the other of the third and fourth securing members, wherein the top and bottom spanning panels extend substantially a length of the inner and outer structural members to space the inner and outer structural members at a predetermined distance, and wherein the inner and outer structural members and the top and bottom spanning panels define an interior volume therein;

e) an insulation member disposed within the interior volume, wherein the outer structural members extend between one of the top and bottom spanning panels; and wherein the first retaining feature of a first block module of the plurality of block modules is adapted to slidably engage the opposite edges of the top spanning panel of at least one vertically adjacent block module of the plurality of block modules, and wherein the first retaining feature includes at least one engagement rail that is configured to engage one opposite side of the top spanning panel of the at least one vertically adjacent block module, wherein slidable engagement between the first block module and the at least one vertically adjacent block module secures and vertically and laterally aligns the first block module and the at least one vertically adjacent block module substantially free of the use of mortar, and wherein the first block module is unable to slidably engage two block modules of the at least one vertically adjacent block module when the two block modules are free of at least one of vertical and lateral alignment.

6. The modular block system of claim 5, wherein the first retaining feature includes opposing first and second engagement rails that extend toward one another, and wherein the opposing first and second engagement rails are adapted to receive a second retaining feature of the top spanning panel of the at least one vertically adjacent block module.

7. The modular block system of claim 5, wherein the first retaining feature includes opposing first and second engagement rails that extend toward one another to define opposing panel reception channels, and wherein the opposing panel reception channels are adapted to receive the opposite edges of the top spanning panel of the at least one vertically adjacent block module.

8. The modular block system of claim 5, wherein each of the inner and outer structural members includes upper and lower retaining grooves, wherein the upper retaining grooves are adapted to receive the third and fourth securing members, respectively, and wherein the lower retaining grooves are adapted to receive the first and second securing members, respectively.

9. The modular block system of claim 8, wherein each of the first, second, third and fourth securing members includes a hollow interior portion and a slot that extends a length of the hollow interior portion that is adapted to receive a corresponding expansion member, wherein insertion of the corresponding expansion member into each hollow interior is configured to expand each of the corresponding first, second, third and fourth securing members at the respective slot, wherein a corresponding securing member of the first, second, third and fourth securing members expands within an expanded inner portion of the respective upper and lower retaining grooves to secure the corresponding securing member therein.

10. The modular block system of claim 5, wherein the inner and outer structural members are masonry.

11. The modular block system of claim 5, wherein the top and bottom spanning panels are made of plastic.

12. A method for assembling a mortar free modular block system, the method comprising the steps of:

providing a plurality of block modules, each of the plurality of block modules including:

a) inner and outer structural members;

b) a bottom spanning member extending a length of the inner and outer structural members, wherein the bottom spanning member includes a first retaining feature;

c) a top spanning member extending a length of the inner and outer structural members, wherein the top spanning member includes a second retaining feature that cooperates with the first retaining feature of an adjacent block module, wherein each of the inner and outer structural members includes expanded inner portions that receive the top and bottom spanning members, wherein the expanded inner portion extends a length of each respective inner and outer structural member, wherein each expanded inner portion is accessible through a securing aperture disposed at an end of the expanded inner portion, wherein each securing aperture is defined within an end wall of a respective inner and outer structural member;

d) an insulation member disposed within an interior volume defined between the inner and outer structural members and the top and bottom spanning members, wherein the top and bottom spanning members compress the insulation member between the inner and outer structural members to form a unitary block module, wherein the top spanning member includes first and second securing members that are configured to be secured within the expanded inner portion of upper retaining grooves of the inner and outer structural members, respectively, and wherein the bottom spanning member includes third and fourth securing members, wherein each of the first, second, third and fourth securing members includes a hollow interior portion that is configured to be secured within the expanded inner portion of lower retaining grooves of the inner and outer structural members, wherein the first, second, third and fourth securing members are configured to position the inner and outer structural members at a predetermined distance;

placing at least two adjacent block modules to define a lower course;

aligning the at least two adjacent block modules to be vertically and laterally aligned within the lower course; and sliding a vertically adjacent block module onto the at least two adjacent block modules within the lower course, wherein the vertically adjacent block module defines a higher course, wherein the first retaining feature of the vertically adjacent block module slidably engages the second retaining feature of two of the at least two block modules, wherein a slidable connection between the at least two block modules of the lower course and the vertically adjacent block module of the higher course creates a secure and self-leveling interference connection that is substantially free of mortar.

13. The method of claim 12, further comprising the step of:

inserting a corresponding expansion member into the respective hollow interior portion of the first, second, third and fourth securing members, respectively, wherein each corresponding expansion member is inserted through a corresponding securing aperture disposed at the respective ends of the expanded inner portions, wherein insertion of the corresponding expansion member into each hollow interior is configured to expand each of the corresponding first, second, third and fourth securing members within the corresponding expanded inner portion of the upper and lower retaining grooves.

14. A block module for a modular block system, each block module comprising:

inner and outer structural components;

an insulation member engaged with the structural component; and first and second mortar-free retaining features extending outward from the inner and outer structural components, the first mortar-free retaining feature being integrally formed with a first spanning member extending between the first and second structural components, and the second mortar-free retaining feature being integrally formed with a second spanning member that opposes the first spanning member and extends between the first and second structural components, wherein the first and second spanning members position the inner and outer structural components at a predetermined spacing, wherein the first retaining feature is configured to matingly and slidably engage a second retaining feature of an adjacent block module.

15. The block module of claim 14, wherein the insulation member is disposed between the inner and outer structural components.

16. The block module of claim 15, first and second spanning members exert a laterally inward compressive force against the inner and outer structural components to compress the insulation member between the inner and outer structural components and secure the inner and outer structural components, the first and second spanning members and the insulation member in a unitary member to form the block module.

* * * * *